US011719027B2

(12) United States Patent
Alexander et al.

(10) Patent No.: US 11,719,027 B2
(45) Date of Patent: Aug. 8, 2023

(54) MECHANICAL OBJECT TRACKING SYSTEM

(71) Applicant: Byron Alexander, San Antonio, TX (US)

(72) Inventors: Byron Alexander, San Antonio, TX (US); Cole Korte, Pflugerville, TX (US); Boris Bass, Spring, TX (US)

(73) Assignee: Byron Alexander, San Antonio, TX (US)

( * ) Notice: Subject to any disclaimer, the term of this patent is extended or adjusted under 35 U.S.C. 154(b) by 114 days.

(21) Appl. No.: 17/301,848

(22) Filed: Apr. 15, 2021

(65) Prior Publication Data

US 2022/0333415 A1 Oct. 20, 2022

(51) Int. Cl.
*E05C 3/34* (2006.01)
*E05B 35/12* (2006.01)
(Continued)

(52) U.S. Cl.
CPC ..... *E05C 3/34* (2013.01); *E05B 35/12* (2013.01); *E05B 63/127* (2013.01); *E05B 15/08* (2013.01);
(Continued)

(58) Field of Classification Search
CPC ..... Y10T 70/7446; Y10T 292/0854; Y10T 292/0856; Y10T 292/0862;
(Continued)

(56) References Cited

U.S. PATENT DOCUMENTS 537,311 A * 4/1895 Schade ..... E05B 35/12 70/265
2,064,474 A * 12/1936 Hopkins ..... G07C 1/20 70/389
(Continued)

FOREIGN PATENT DOCUMENTS

DE 3140243 A1 4/1983
FR 2878880 A1 6/2006
JP 2004108108 A 4/2004

OTHER PUBLICATIONS

Cobra Key Systems, Cobra Key Cabinets, Cobra Key Systems, 2016, retrieved from the internet https://cobrakey.com/.
(Continued)

*Primary Examiner* — Christine M Mills
*Assistant Examiner* — Faria F Ahmad
(74) *Attorney, Agent, or Firm* — Craige Thompson; Thompson Patent Law; Timothy D. Snowden

(57) ABSTRACT

Apparatus and associated methods relate to an access control system having a planar interlocking mechanism including two reflectively symmetric rotating moon gears mechanically coupled by a linear slide configured to respond to rotation of the moon gears. In an illustrative example, the moon gears are mechanically coupled by the linear slide via respective actuating cams. The moon gears may be provided, for example, with locking cams configured to releasably secure the linear slide via a corresponding follower on the linear slide. Rotation of one moon gear into a first mode may, for example, place the other moon gear in a second mode, and vice versa. Each moon gear may be configured, for example, to be operated by a removable peg. Various embodiments may advantageously be configured such that release of a removable peg from one moon gear captures a peg in a corresponding moon gear.

20 Claims, 38 Drawing Sheets

(51) Int. Cl.
*E05B 63/12* (2006.01)
*E05B 15/08* (2006.01)

(52) U.S. Cl.
CPC .... *Y10T 292/0854* (2015.04); *Y10T 292/0856* (2015.04); *Y10T 292/0862* (2015.04); *Y10T 292/0863* (2015.04); *Y10T 292/0866* (2015.04); *Y10T 292/0911* (2015.04)

(58) Field of Classification Search
CPC ..... Y10T 292/0863; Y10T 292/0866; Y10T 292/0911; Y10T 292/0916; Y10T 292/0925; Y10T 292/0945; Y10T 292/0947; Y10T 292/0823; Y10T 292/0826; Y10T 292/1039; Y10T 292/1044; Y10T 292/1046; Y10T 292/1077; Y10T 70/7768; Y10T 70/8784; Y10T 292/0825; E05B 35/086; E05B 35/12; E05B 63/127; E05B 15/08; E05B 65/0858; E05B 63/185; E05B 11/00; E05B 35/08; E05C 3/34; E05C 9/041
See application file for complete search history.

(56) References Cited

U.S. PATENT DOCUMENTS 2,220,786 A * 11/1940 Grainger ..... E05B 35/086 70/389
2,762,216 A * 9/1956 Wasson ..... E05B 35/12 70/339
3,154,938 A * 11/1964 Cohen ..... E05B 35/12 70/265
3,744,829 A * 7/1973 Germer ..... E05C 9/12 292/96
3,899,201 A * 8/1975 Paioletti ..... E05B 65/0858 292/25
4,441,348 A 4/1984 Neilsen
4,472,952 A 9/1984 Hollowell, Jr.
4,567,741 A 2/1986 Trempala
4,641,509 A 2/1987 Batchelor et al.
4,958,508 A * 9/1990 Lin ..... E05C 3/34 70/355
5,020,347 A 6/1991 Logan
5,172,944 A * 12/1992 Munich ..... E05C 9/021 292/51
5,372,021 A 12/1994 Smith
5,505,066 A 4/1996 Baucom
5,842,362 A 12/1998 DePonty et al.
5,878,613 A 3/1999 Tabacchi et al.
D407,962 S 4/1999 Conder
5,951,068 A * 9/1999 Strong ..... E05C 9/041 292/29
6,178,792 B1 * 1/2001 Glazier ..... E05B 35/086 70/389
6,612,142 B1 9/2003 Capwell
6,837,084 B2 1/2005 Bailey et al.
7,965,190 B2 6/2011 Maloney
8,011,216 B2 9/2011 Mielonen et al.
8,661,864 B1 3/2014 Guessford
8,931,812 B1 * 1/2015 Hauber ..... E05C 19/12 292/37
9,041,536 B2 5/2015 Guessford
9,165,442 B2 10/2015 Guessford
10,580,242 B2 * 3/2020 Ray ..... G06K 7/1404
2004/0163977 A1 8/2004 Sedon et al.
2004/0227349 A1 * 11/2004 Denys ..... E05B 65/0858 292/26
2004/0245784 A1 * 12/2004 Tsai ..... E05B 65/0858 292/51
2006/0076783 A1 * 4/2006 Tsai ..... E05B 15/024 292/24
2006/0130543 A1 * 6/2006 Alchin ..... E05C 9/047 70/100
2006/0188304 A1 * 8/2006 Yamazaki ..... G03G 21/1619 399/388
2007/0068205 A1 * 3/2007 Timothy ..... E05B 63/185 70/100
2007/0193318 A1 8/2007 Churchill et al.
2007/0290511 A1 * 12/2007 Liang ..... E05B 65/0858 292/24
2008/0060400 A1 * 3/2008 Ling ..... E05B 37/14 70/389
2008/0256992 A1 * 10/2008 Chung ..... E05B 65/0811 70/77
2009/0241619 A1 10/2009 Kuester et al.
2020/0325709 A1 10/2020 Irwin et al.

OTHER PUBLICATIONS

Keyper Systems, Mechanical Key Control & Peg Systems, 2020, retrieved from the internet https://www.keypersystems.com/products/mechanical-key-control/.
Vanguard, Double-hook Mortise Lock, retrieved from the internet Apr. 15, 2021, https://www.reflectwindow.com/products/double-hook-mortise-lock.
International Search Report and Written Opinion of the International Searching Authority in related International Application No. PCT/US2022/071748, dated Aug. 10, 2022, 12 pages.

* cited by examiner

145B

MECHANICAL OBJECT TRACKING SYSTEM

TECHNICAL FIELD

Various embodiments relate generally to access control systems.

BACKGROUND

Entities (e.g., companies, organizations, individuals) may have locked assets and/or locked asset repositories. Access to repositories may, for example, be provided by keys. Access to keys may be restricted to authorized personnel.

SUMMARY

Apparatus and associated methods relate to an access control system having a planar interlocking mechanism including two reflectively symmetric rotating moon gears mechanically coupled by a linear slide configured to respond to rotation of the moon gears. In an illustrative example, the moon gears are mechanically coupled by the linear slide via respective actuating cams. The moon gears may be provided, for example, with locking cams configured to releasably secure the linear slide via a corresponding follower on the linear slide. Rotation of one moon gear into a first mode may, for example, place the other moon gear in a second mode, and vice versa. Each moon gear may be configured, for example, to be operated by a removable peg. Various embodiments may advantageously be configured such that release of a removable peg from one moon gear captures a peg in a corresponding moon gear.

Various embodiments may achieve one or more advantages. For example, some embodiments may advantageously provide tracking of assets. An access peg identifying a user may advantageously be captured when operated to release an asset peg. Various embodiments may advantageously reduce a quantity of parts used in a (mechanical) access control system. Various embodiments may advantageously achieve multiple configurations with one set of components (e.g., identical molds). Various embodiments may be readily assembled with minimal or no tools. Accordingly, various embodiments may advantageously achieve cost savings. Various embodiments may increase durability and/or life expectancy by providing rotating and/or sliding parts with low stress, strain, and/or flexion imposed during operation. Various embodiments may advantageously increase accountability. Various embodiments may advantageously reduce and/or eliminate costs due to lost keys and/or other assets.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

To aid understanding, this document is organized as follows. First, to help introduce discussion of various embodiments, an exemplary access control unit 110 is introduced with reference to FIG. 1. Second, that introduction leads into a description with reference to FIG. 2 of an exemplary interlocking mechanism 140 which may be used with the access control unit 110. Third, with reference to FIGS. 3A-6, exemplary details and methods of operation of the access control unit 110 and interlocking mechanism 140 are described. Fourth, with reference to FIGS. 7A-8, the discussion turns to exemplary embodiments that illustrate exemplary assemblies utilizing multiple access control units 110. Fifth, and with reference to FIGS. 9A-16G this document describes exemplary views of the exemplary access control unit 110 and selected components thereof. Finally, the document discusses further embodiments, exemplary applications and aspects relating to access control systems.

Figure 1:
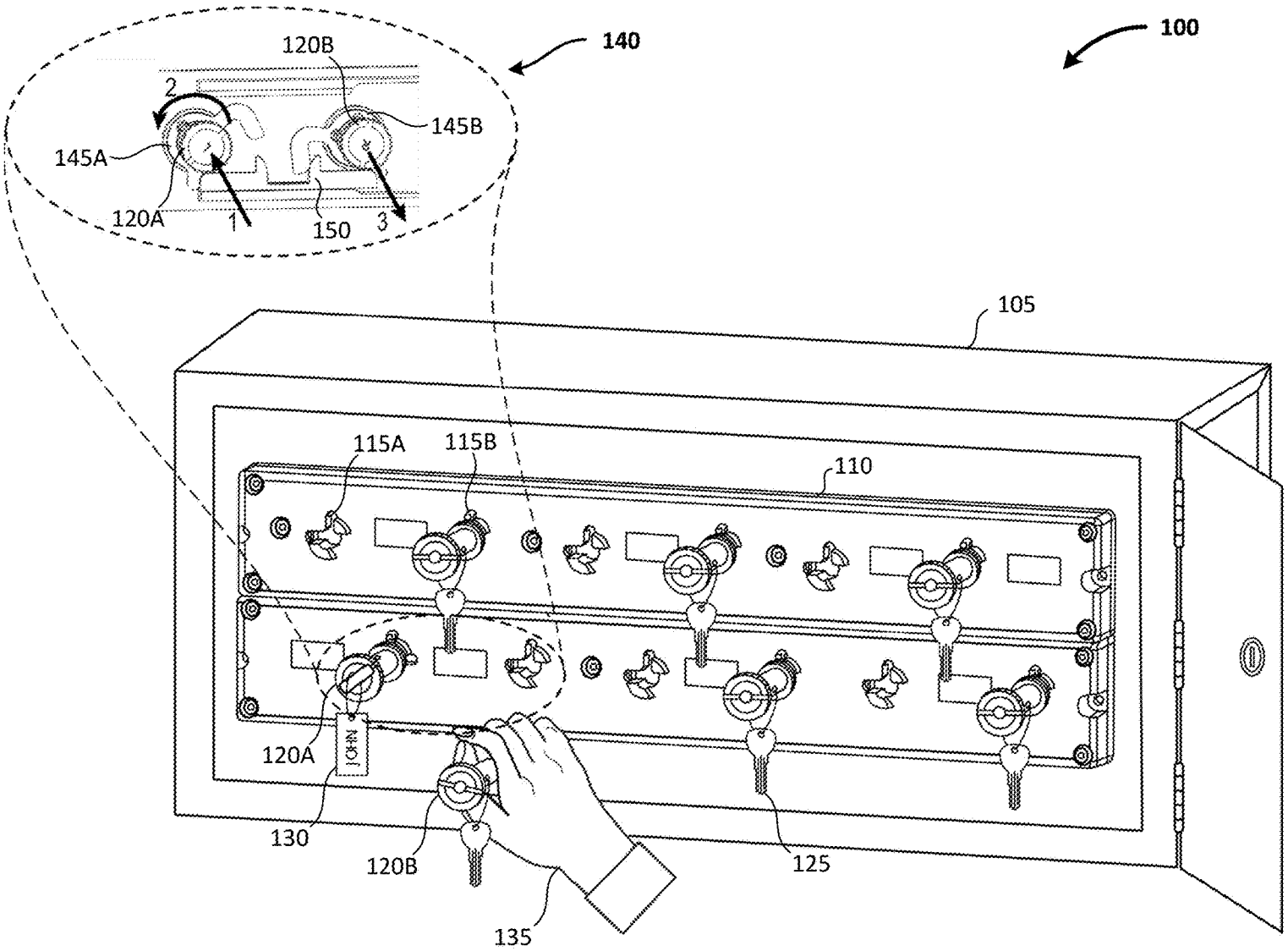
FIG. 1 depicts an exemplary access control unit 110 employed in an illustrative use-case scenario for tracking access of users to keys.

FIG. 1 depicts an exemplary access control unit 110 employed in an illustrative use-case scenario for tracking access of users to keys. in the illustrative use case scenario 100, a locking cabinet 105 is provided with two of the access control units 110 in a vertically stacked configuration. Each access control unit 110 is provided with multiple pairs of first access ports 115A and second access ports 115B. In the depicted example, each of several access pegs 120A or asset pegs 120B are releasably secured within a corresponding second access port 115B. Each asset peg 120B may be coupled to an asset. In the depicted example, each asset pegged 120B is coupled to a corresponding key 125. Each access peg 120 may be coupled to an identifying visual indicium 130 (e.g., a name tag). The visual indicium 130 may, for example, identify a user 135 to which a particular access peg 120A was assigned.

Each pair of access peg 120A and asset peg 120B may be interlockingly coupled by an interlocking mechanism 140. In the depicted example, the interlocking mechanism 140 includes substantially radially symmetric moon gears 145A and 145B in mechanical communication via a linear slide 150. The interlocking mechanism 140 may releasably secure at least one of the access key 120A and the asset key 120B. For example, a moon gear 145 may receive a peg 120 and, when operated, rotate the peg 120 into an orientation preventing removal of the peg 120 from the corresponding access port 115.

In the depicted example, a user 135 gains access to a particular asset peg 120B by inserting ("1") an access peg 120A into an access port 115A and thereinto into the corresponding moon gear 145A. The user then operates the moon gear 145A by rotating ("2") the access peg 120A. The moon gear 145A operates the second moon gear 145B via linear slide 150. Accordingly, the corresponding asset peg 120B is rotated into an orientation allowing withdrawal ("3") of the asset peg 120B through the corresponding access port 115B. Rotation of the access peg 120A to operate the interlocking mechanism 140 to release the asset peg 120B rotates the access peg 120A into an orientation which prevents withdrawal of the access peg 120A from the corresponding access port 115A. The user 135 may thereby release the asset peg 120B and gain access to a desired key 125, and the user's access key 120A is releasably captured. Accordingly, a (visual) record of the last access key 120A used to gain access to a particular asset 125 is advantageously maintained.

Figure 2A:
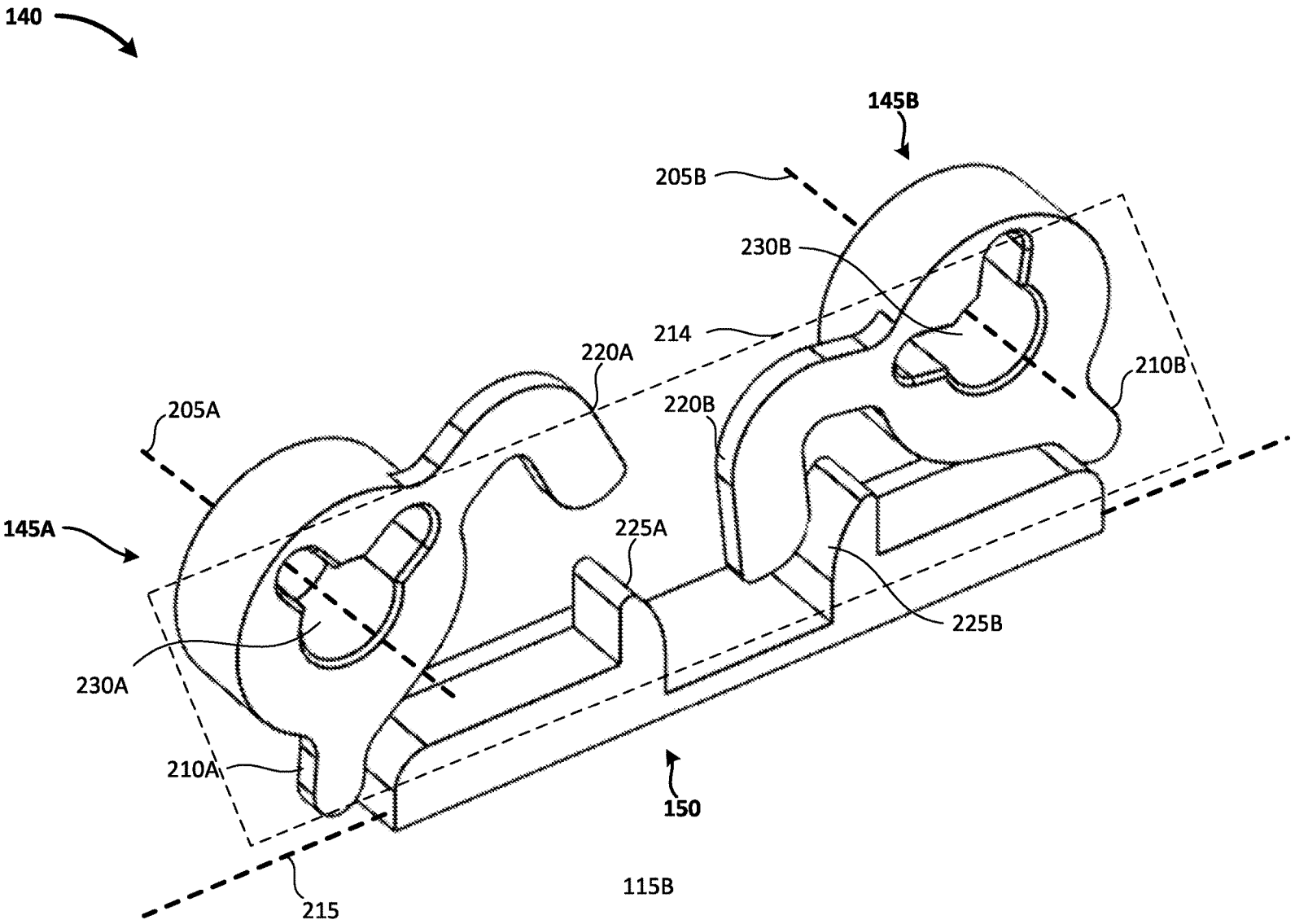
FIG. 2A and FIG. 2B depict an exemplary interlocking mechanism (IM) 140 used to selectively retain access control elements in an exemplary access control unit.
Figure 2B:
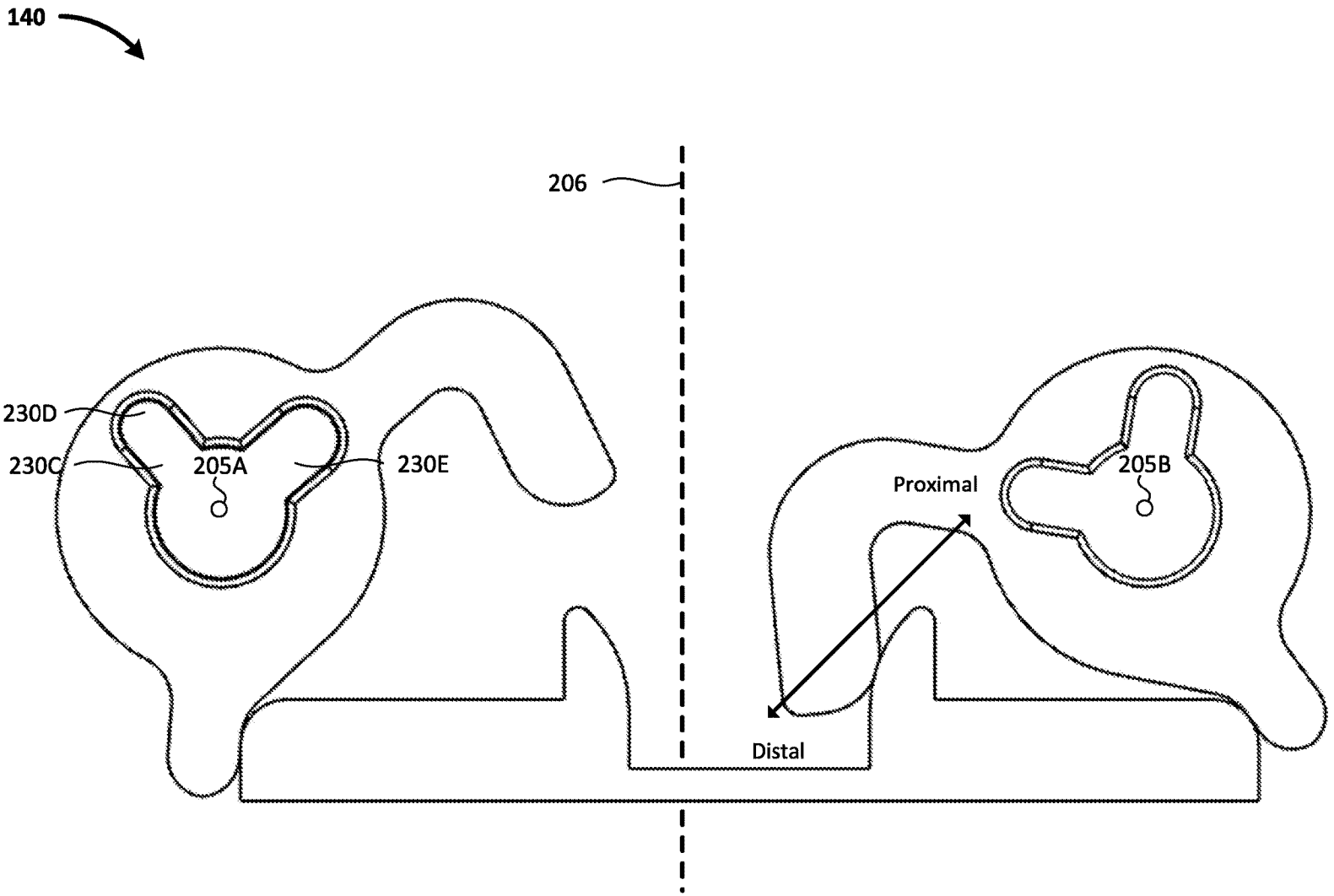

FIG. 2A and FIG. 2B depict an exemplary interlocking mechanism (IM) 140 used to selectively retain access control elements in an exemplary access control unit. The interlocking mechanism 140 has two moon gears 145 configured to rotate in a first plane about respective axes 205 orthogonal to the first plane 214. The moon gears 145 may be referred to, by way of example and not limitation, as cam drivers. Each moon gear 145 has at least two cam elements extending (e.g., substantially radially) from a body of the moon gear 145. The cam elements may include, as depicted, an actuating cam 210A (e.g., a 'pushing' element). The actuating cam 210A may be configured to urge departure of a body away from the moon gear 145. The cam elements may include, as depicted, a locking cam 220A (e.g., a 'locking,' 'hooking,' and/or 'retrieving' element). The locking cam 220A may be configured to urge approach of a body towards the moon gear 145, to lock a body in a predetermined range of proximity to the moon gear 145, or some combination thereof. For example, the locking cam 220A may be provided with and/or configured as a 'hook' element with a cam surface at least partially on an inner surface of the hook element (proximal to the body of the moon gear 145 on a radius extending orthogonal to the corresponding axis 205).

In the depicted example, left moon gear 145A and right moon gear 145B are disposed in functional reflective symmetry of one another about an axis 206. The linear slide 150 of the interlocking apparatus 140 is configured to respond to rotation of the moon gears 145 by translation in the first plane along a third axis 215 substantially orthogonal to the axis of reflective symmetry 206 of the moon gears.

When one of the moon gears (e.g., a left moon gear 145A) rotates in a first rotational direction (e.g., counterclockwise), the actuating cam 210A of the moon gear displaces the linear slide along the third axis 215 towards the axis of rotation 205B of the other moon gear 145B (e.g., to the right). The moon gear thereby causes the linear slide 150 to engage an actuating cam 210B of the other moon gear 145B. As the linear slide 150 is displaced to engage the actuating cam 210B, the other moon gear 145B is thereby rotated in the first rotational direction. The rotation may continue until a locking cam 220B (e.g., a substantially hook-shaped structure, as depicted) of the other moon gear 145B releasably secures a first follower 225B of the linear slide 150 (e.g., extending upwards in the first plane from the linear slide 150).

The locking cam 220B (e.g., a 'hook') of the other moon gear 145B may retainingly engage the linear slide 150. For example, the locking cam 220B of the other moon gear 145B may hook over the first follower 225B of the linear slide 150 such that the linear slide 150 is releasably retained in place until the locking cam 220B is disengaged from the follower 225B. The locking cam 220B may, for example, be provided with a cam surface that may 'draw' the linear slide along the axis 215 toward the associated moon gear and into a 'locked position.'

When the locking cam 220B of the other moon gear 145B secures the first follower 225B, a second follower 225A of the linear slide 150 (e.g., substantially parallel to and/or in reflectively symmetry with the first follower) is displaced past a locking cam 220A surface of the moon gear 145A such that the moon gear 145A is blocked from rotation in an opposite direction (e.g., counterclockwise). For example, the second follower 225A may protrude upward such that the locking cam 220A would collide with an upper end of the follower without engaging a following surface 225A thereof. The moon gear 145A is thereby placed into a first mode (e.g., 'locked') and the other moon gear 145B into a second mode (e.g., 'unlocked'). When the other moon gear 145B rotates in the opposite rotational direction (e.g., clockwise), the operations reverse and the moon gear 145A is thereby placed into the second mode and the other moon gear 145B is placed into the first mode.

In the depicted example, each moon gear 145 is provided with a corresponding cavity 230. The cavity 230 may be configured, for example, such that a corresponding peg 120 is matingly received thereinto. For example, the moon gear 145A may be configured to receive an access peg 120A into a cavity 230A and the moon gear 145B may be configured to receive an asset peg 120B into a cavity 230B. The cavities 230 may be configured such that a corresponding peg may drive rotation of the moon gear 145 and/or may be driven by rotation of the moon gear (e.g., via rotation of a corresponding moon gear mechanically coupled by a linear slide 150 in an interlocking mechanism 140). In the depicted example, the cavities 230 are provided with radially extending 'lobes' 230C configured to mate with corresponding radial extensions of a corresponding peg 120. Accordingly, the interlocking mechanism 140 may quickly and easily alternate between retaining a key in one of the two access ports 115 corresponding to the two moon gears 145 of the interlocking apparatus 140.

As depicted, the interlocking apparatus 140 may be assembled with minimal and/or no tools. The interlocking apparatus 140 may be operated with minimal stress, shear, and/or flexion of each component. Each component may, for example, be manufactured without complex molds and/or manufacturing operations. Accordingly, various embodiments may advantageously be cost-effective to produce and/or assemble. Various embodiments may advantageously increase durability and/or life expectancy.

Figure 3B:
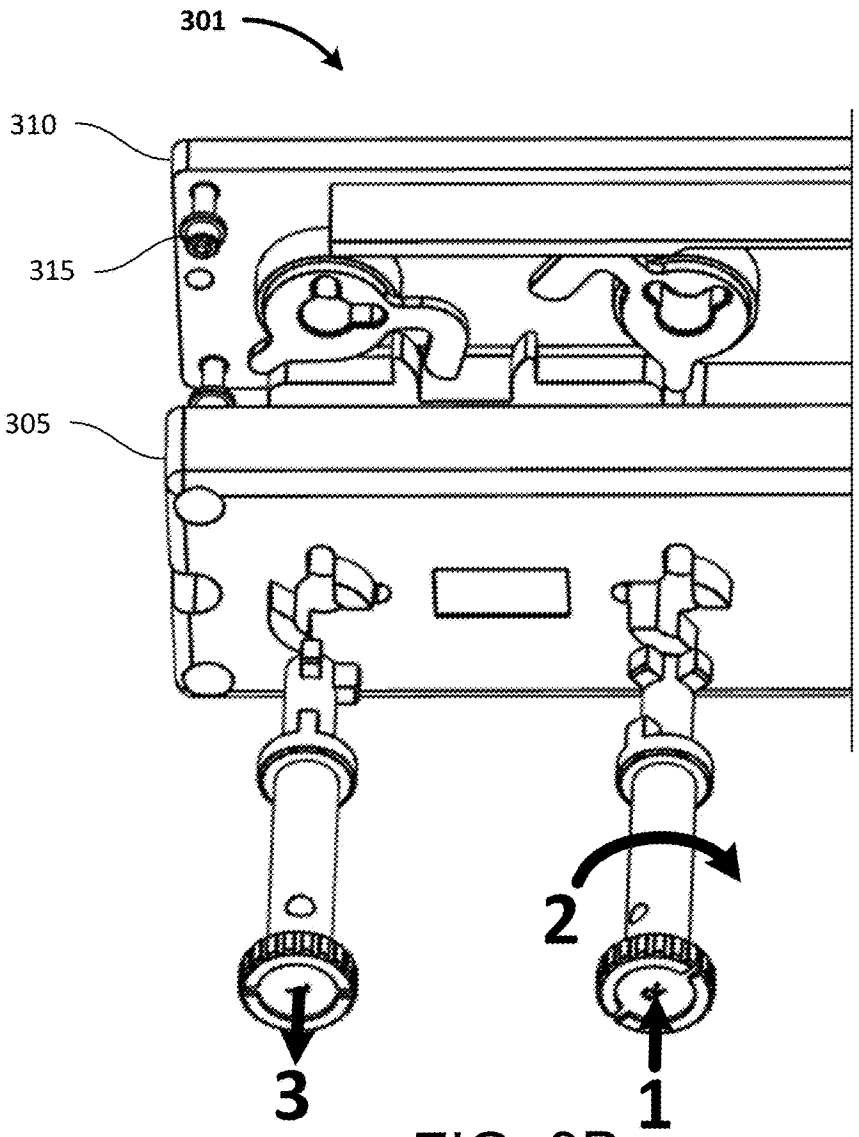
FIG. 3B depicts an exploded view of the exemplary access control unit 110 of FIG. 1 with the exemplary interlocking mechanism 140 of FIG. 2 configured such that the first moon gear 145A is in the second mode and the second moon gear 145B is in the first mode.
Figure 3A:
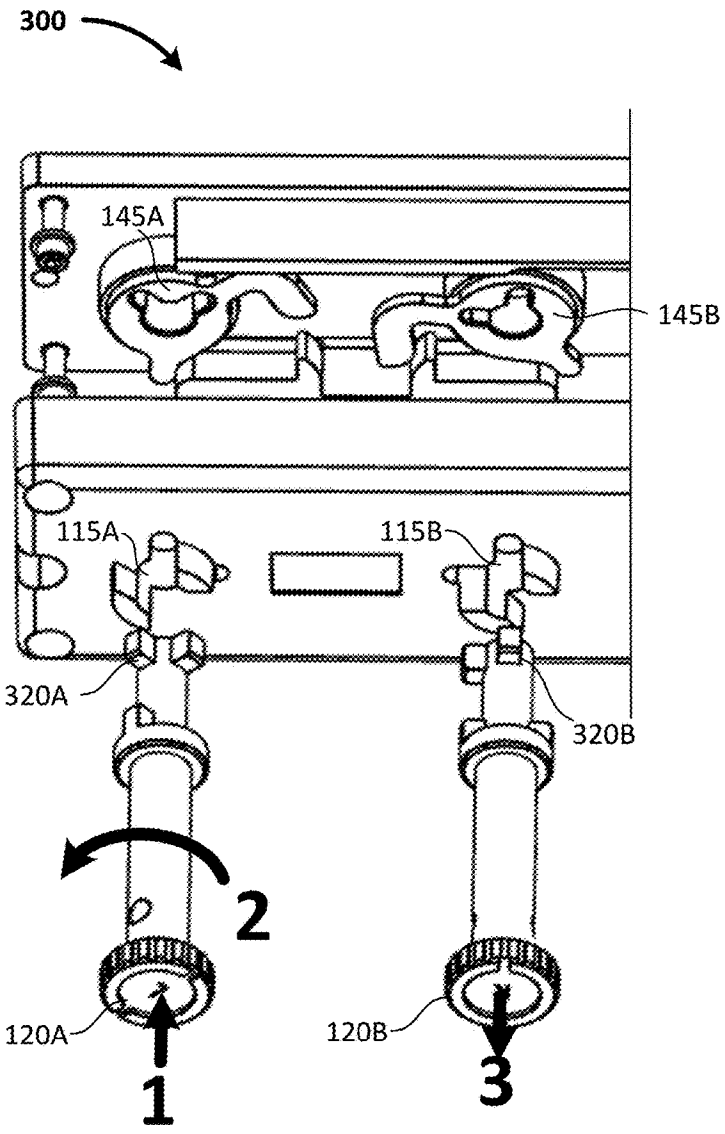
FIG. 3A depicts an exploded view of the exemplary access control unit 110 of FIG. 1 with the exemplary interlocking mechanism 140 of FIG. 2 configured such that a first moon gear 145A is in a first mode and a second moon gear 145B is in a second mode.

FIG. 3A depicts an exploded view of the exemplary access control unit 110 of FIG. 1 with the exemplary interlocking mechanism 140 of FIG. 2 configured such that a first moon gear 145A is in a first mode and a second moon gear 145B is in a second mode. A pair of moon gears 145 are disposed within amazing combination of a front housing 305 and a rear carrier 310. The housing 305 and the carrier 310 are mechanically and releasably coupled buy fasteners 315. The housing 305 is provided with the access ports 115. The access ports 115 and housing 305 may be configured to register a corresponding peg 120 on the corresponding axis of rotation 205 of the corresponding moon gear 145 when the peg 120 is brought into register and inserted through the access port 115. As depicted, each access port 115 is configured to permit insertion of the corresponding peg 120 only in a fixed orientation corresponding to a first (e.g., 'unlocked') mode of the corresponding moon gear 145.

In the first configuration 300, the first peg 120A is inserted ("1") into the corresponding access port 115A, and therethrough into a corresponding cavity 230A in the moon gear 145A. The peg 120A is provided with protruding elements 320A configured to mate with corresponding engagement features in the cavity 230A. Once the engagement features 320A are seated in the cavity 230A, the peg 120A is operated (e.g., rotated) ("2") to rotate the corresponding moon gear 145A into the first mode (e.g., 'locked'). The moon gear 145A thereby operates the other moon gear 145B via the linear slide 150, placing the other moon gear 145B into the second mode (e.g., 'unlocked').

As depicted, in the second mode, the cavity 230B of the moon gear 145B is oriented such that the engagement elements 320B of the peg 120B are aligned with the corresponding access port 115B such that the peg 120B may be withdrawn ("3") through the access port 115B. Accordingly, a user may, by way of example and not limitation, advantageously use the first peg 120A to operate the interlocking mechanism 140 and release the second peg 120 B. Furthermore, the first peg 120A may be advantageously captured by the interlocking mechanism 140. The first peg 120A may, for example, identify a user to which the peg 120A is assigned. Accordingly, a visual indicator may, by way of example and not limitation, advantageously be captured in the interlocking mechanism 140 to indicate a user who removed the peg 120B.

FIG. 3B depicts an exploded view of the exemplary access control unit 110 of FIG. 1 with the exemplary interlocking mechanism 140 of FIG. 2 configured such that the first moon gear 145A is in the second mode and the second moon gear 145B is in the first mode. In the second configuration 301, the second peg 120B is inserted ("1") into the corresponding access port 115B, and therethrough into a corresponding cavity 230B in the moon gear 145B. Once the engagement features 320B of the peg 120B are seated in the cavity 230B, the peg 120B is operated (e.g., rotated) ("2") to rotate the corresponding moon gear 145B into the first mode (e.g., 'locked'). The moon gear 145B thereby operates the other moon gear 145A via the linear slide 150, placing the other moon gear 145A into the second mode (e.g., 'unlocked').

As depicted, in the second mode, the cavity 230A of the moon gear 145A is oriented such that the engagement elements 320A of the peg 120A are aligned with the corresponding access port 115A such that the peg 120A may be withdrawn ("3") through the access port 115A. Accordingly, a user may, by way of example and not limitation, advantageously return the second peg 120B and operate it into a 'captured' state to operate the interlocking mechanism 140 and release the first peg 120A. Accordingly, the user may return the second peg 120B (e.g., containing an asset, or a means of access thereto) and thereby recover the peg 120B (e.g., assigned to them and/or containing an indication of their identity).

Figure 4A:
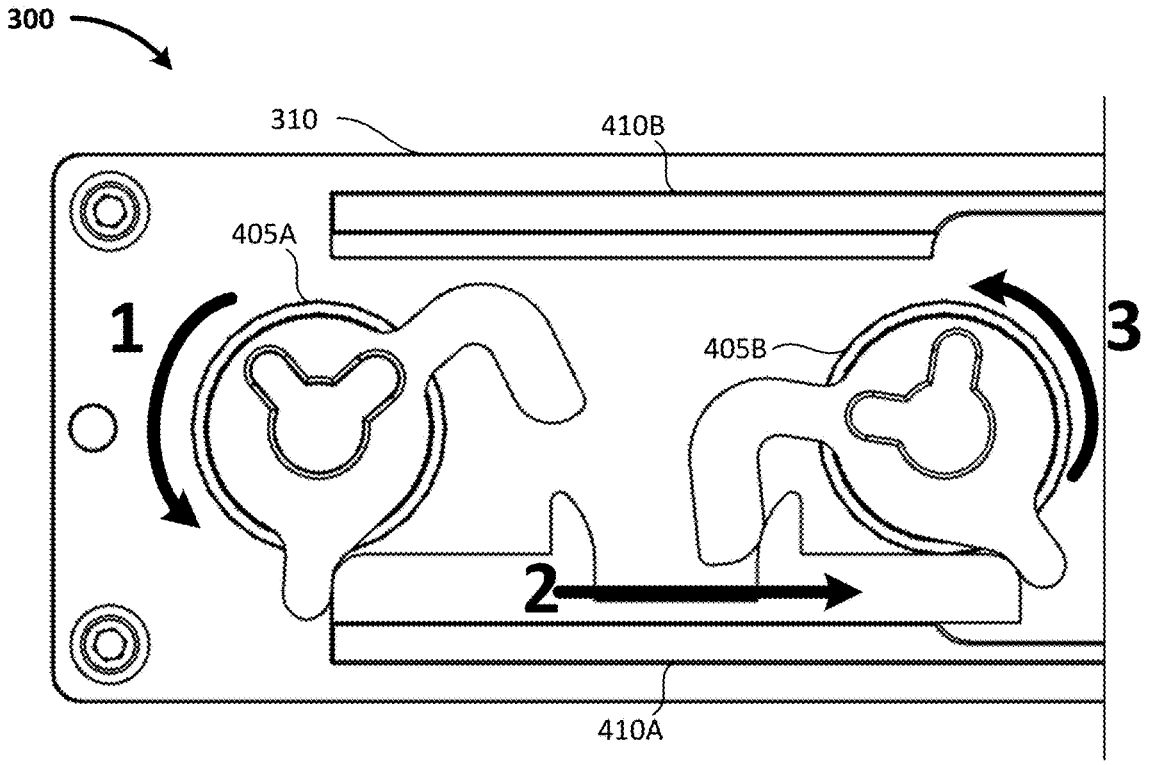
FIG. 4A depicts the exemplary interlocking mechanism 140 of FIG. 2 disposed in an exemplary carrier of access control unit 110 of FIG. 1 and configured such that the first moon gear 145A is in the first mode and the second moon gear 145B is in the second mode.
Figure 4B:
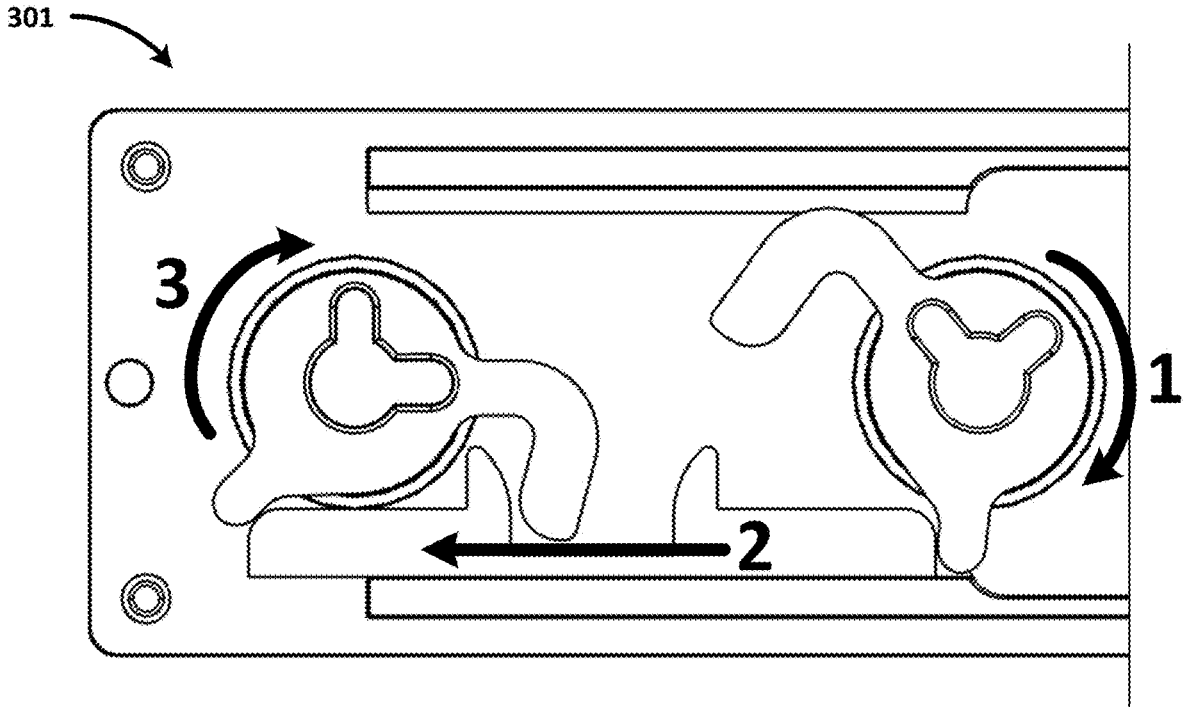
FIG. 4B depicts the exemplary interlocking mechanism 140 of FIG. 2 disposed in an exemplary carrier of access control unit 110 of FIG. 1 and configured such that the first moon gear 145A is in the second mode and the second moon gear 145B is in the first mode.

FIG. 4A depicts the exemplary interlocking mechanism 140 of FIG. 2 disposed in an exemplary carrier of access control unit 110 of FIG. 1 and configured such that the first moon gear 145A is in the first mode and the second moon gear 145B is in the second mode. FIG. 4B depicts the exemplary interlocking mechanism 140 of FIG. 2 disposed in an exemplary carrier of access control unit 110 of FIG. 1 and configured such that the first moon gear 145A is in the second mode and the second moon gear 145B is in the first mode.

The interlocking mechanism 140 (including the moon gears 145 and the linear slide 150) are disposed in the carrier 310. The carrier 310 is provided with substantially circular pockets 405 configured to receive corresponding moon gears 145. As depicted, a moon gear 145A is disposed within a left circular pocket 405A, and a moon gear 145B is disposed within a right circular pocket 405B. The moon gears 145 are rotatably constrained within the corresponding pockets 405. In the depicted embodiment, the linear slide 150 is supported by and slidingly engages a sliding support feature 410A (e.g., a bearing surface) of the carrier body 310.

The carrier body and/or housing may, for example, cooperate to constrain the interlocking apparatus 140 within the first plane and on the various axes of rotation and/or symmetry. In the first configuration 300, counterclockwise rotation ("1") of the moon gear 145A within the pocket 405A imparted linear motion ("2") of the linear slide 150 along the sliding support feature 410A, which imparted corresponding rotation ("3") of the moon gear 145B within the pocket 405B. Similarly, in the second configuration 301, clockwise rotation ("1") of the moon gear 145B within the pocket 405B imparted linear motion ("2") of the linear slide 150 along the sliding support feature 410A, which imparted corresponding rotation ("3") of the moon gear 145A within the pocket 405A.

As depicted, the carrier 310 is further provided with a second sliding support feature 410B. The second sliding support feature 410B may, for example, be a mirror image of the first sliding support feature 410A about a longitudinal axis 310A of the carrier 310. Accordingly, the carrier 310 (and, for example, the housing 305, other related components, or some combination thereof) may be configured such that an interlocking mechanism 140 (e.g., the moon gears 145 and the linear slide 150) may be disposed in the carrier in one of two configurations mirrored about the longitudinal axis 310A. Accordingly, the access control unit 110 may be assembled in one of two configurations: a first configuration (as depicted, with the linear slide 150 sliding on the sliding support feature 410A), and the second configuration, rotated 180 degrees in the first flying such that the linear slide 150 is sliding on the sliding support feature 410B. When the access control unit 110 is assembled in the second configuration and rotated 180 degrees in the first plane 214 relative to the depicted embodiment, the last moon gear may still be 145A. Accordingly, two configurations may be assembled from identical components by disposing the interlocking mechanism in the carrier (and/or other components) in one of two configurations.

Figure 5:
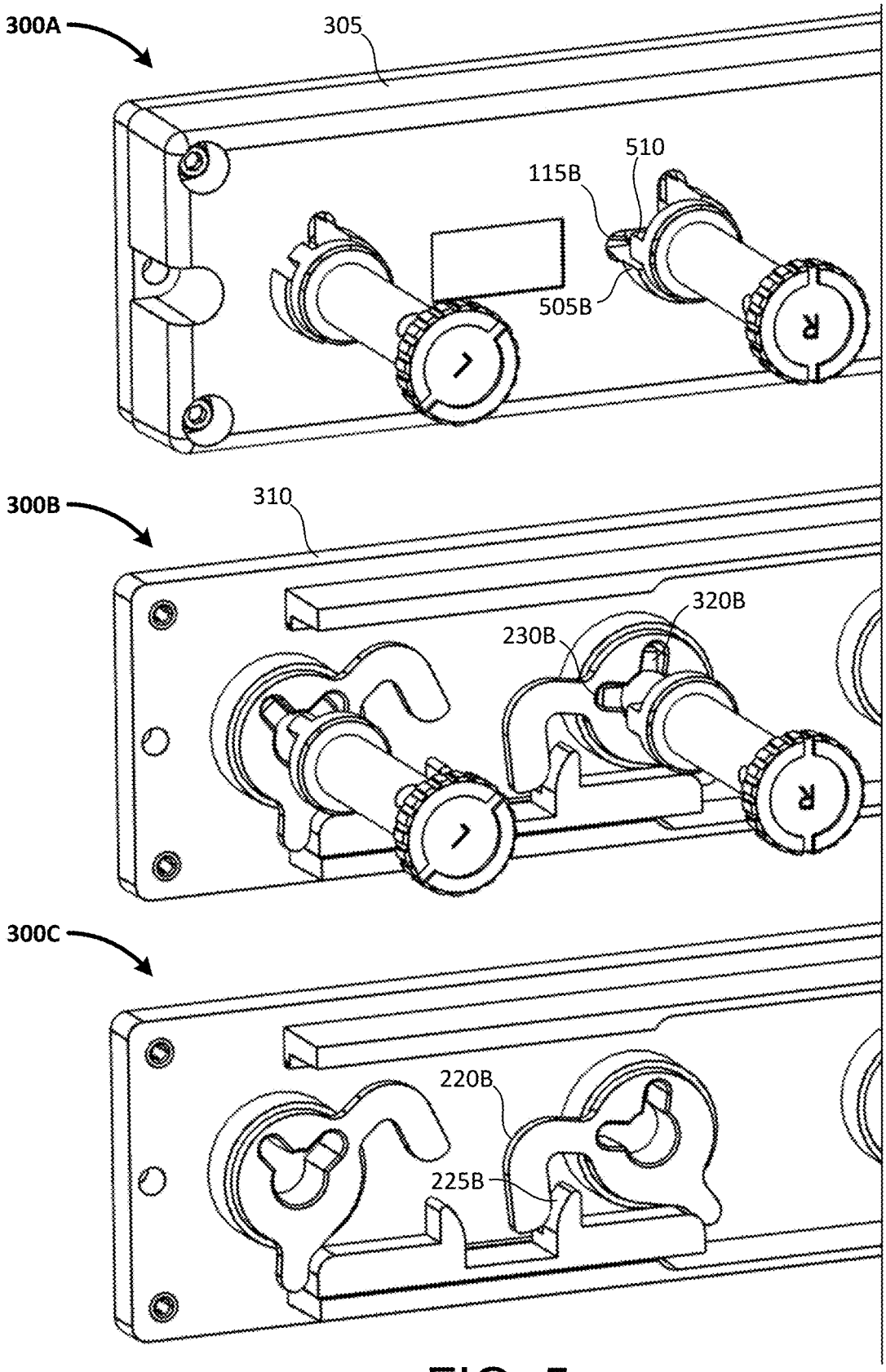
FIG. 5 depicts the exemplary access control unit 110 of FIG. 4A configured such that the first moon gear 145A is in the second mode and the second moon gear 145B is in the first mode: as seen by a user (300A), with a front housing hidden (300B), and with access pegs hidden (300C).
Figure 6:
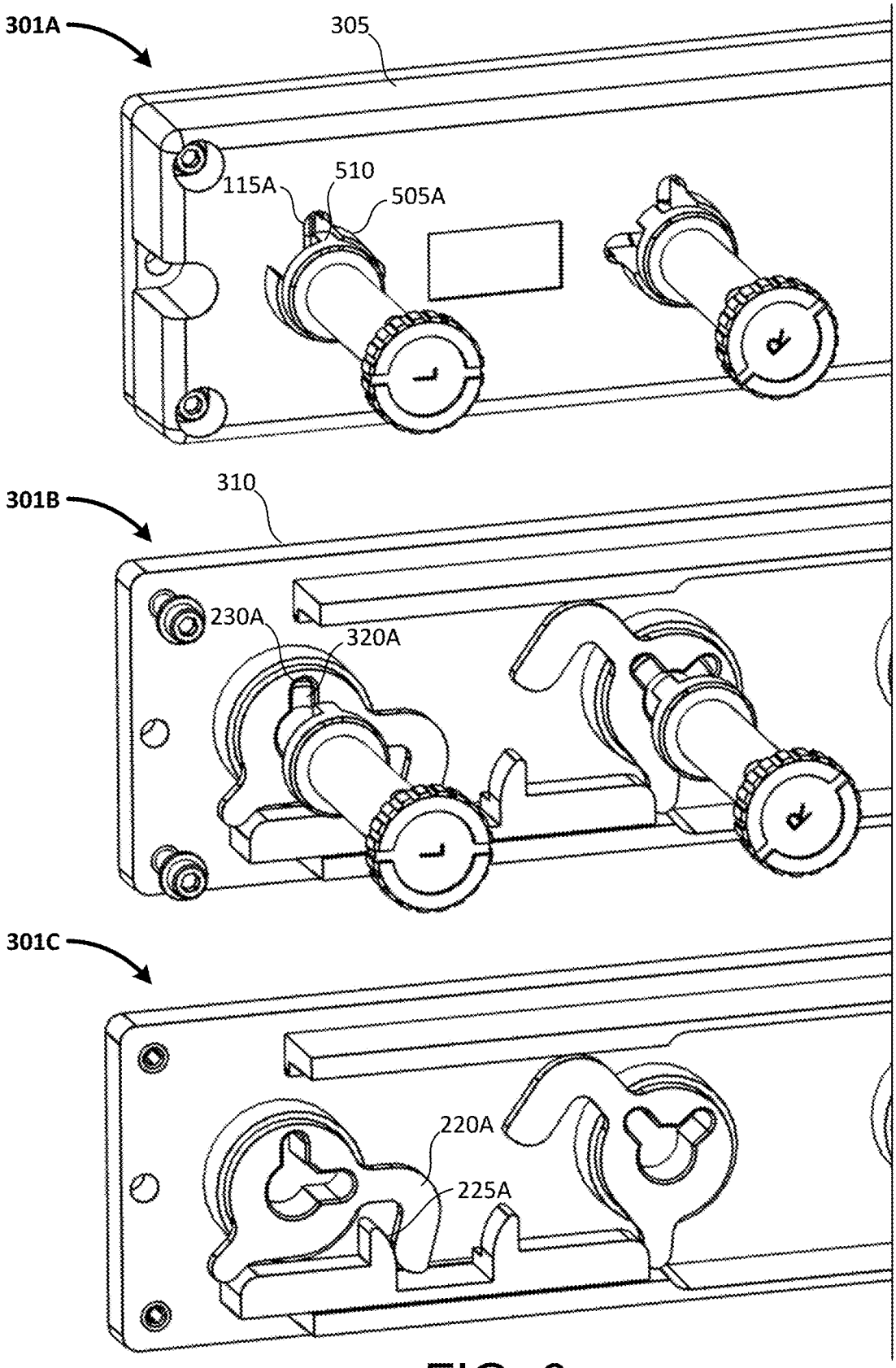
FIG. 6 depicts the exemplary access control unit 110 of FIG. 4B configured such that the first moon gear 145A is in the second mode and the second moon gear 145B is in the first mode: as seen by a user (301A), with the front housing hidden (301B), and with the access pegs hidden (301C).

FIG. 5 depicts the exemplary access control unit 110 of FIG. 4A configured such that the first moon gear 145A is in the second mode and the second moon gear 145B is in the first mode: as seen by a user (300A), with a front housing hidden (300B), and with access pegs hidden (300C). FIG. 6 depicts the exemplary access control unit 110 of FIG. 4B configured such that the first moon gear 145A is in the second mode and the second moon gear 145B is in the first mode: as seen by a user (301A), with the front housing hidden (301B), and with the access pegs hidden (301C).

The housing 305 is provided with orientation limiting elements 505A and 505B protruding from corresponding access ports 115A and 115B. The orientation limiting elements 505 are configured to engage corresponding orientation elements 510 on a peg 120 when inserted through the corresponding access port 115 and seated in the interlocking mechanism 140. Accordingly, rotation of the peg 120 may be limited within a predetermined range.

For example, in the first configuration 300 depicted in FIG. 5, the right peg 120B is operated such that the orientation element 510 is against an orientation limiting element 505B, as shown in 300A. Accordingly, the engagement elements 320B of the peg 120B are oriented with the cavity 230B, as shown in 300B, and the moon gears 145 and the linear slide 150 are operated as shown in 300C.

Similarly, in the second configuration 301 depicted in FIG. 6, the left peg 120A is operated such that the orientation element 510 is against an orientation limiting element 505A, as shown in 301A. Accordingly, the engagement elements 320A of the peg 120A are oriented with the cavity 230A, as shown in 301B, and the moon gears 145 and the linear slide 150 are operated as shown in 301C.

Figure 7B:
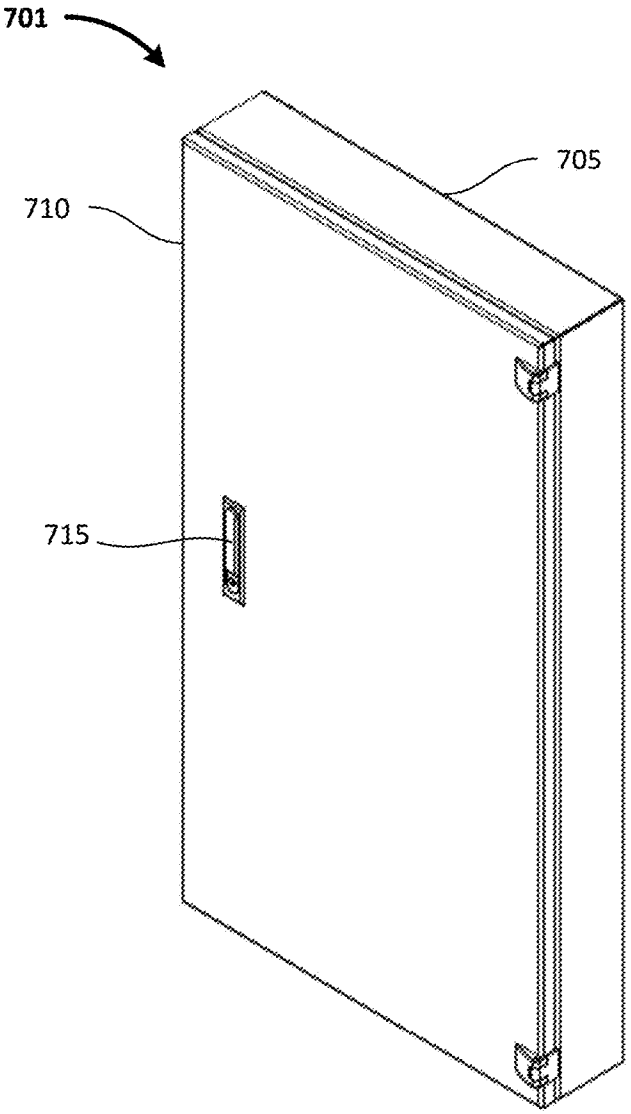
FIG. 7A and FIG. 7B depict exemplary access control units 110 arranged in an exemplary locking cabinet.
Figure 7A:
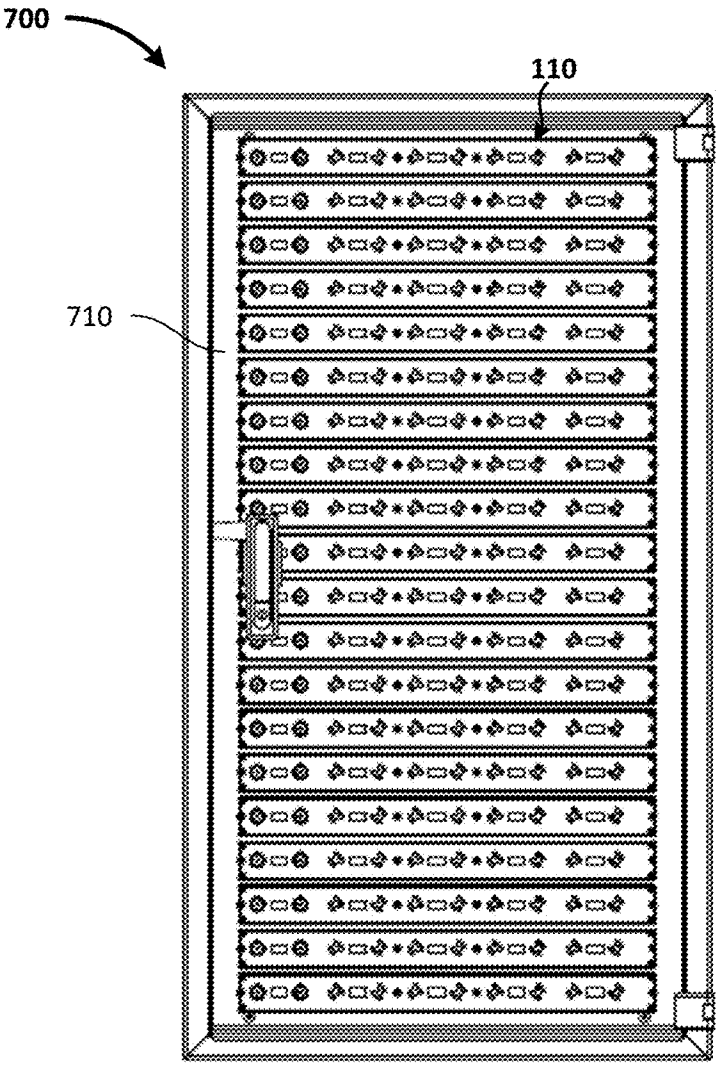

FIG. 7A and FIG. 7B depict exemplary access control units 110 arranged in an exemplary locking cabinet. The locking cabinet 700 and locking cabinet 701 are provided with corresponding cabinet bodies 705, doors 710, and locks 715. As depicted, the door 710 of the cabinet 701 is transparent (e.g., plastic, glass). Within the cabinet body 705, individual access control units 110 are arranged in a vertical stacking configuration. Accordingly, a larger number of keys (or other assets) may be advantageously tracked then in a single unit 110. The lock 715 may, by way of example and not limitation, be mechanical and/or electronic. The lock 715 may, by way of example and not limitation, include a biometric reader, card reader, proximity reader, radiofrequency ID (RFID) reader, keypad, or some combination thereof. Accordingly, access to the access control units may be limited to specific personnel, times, other appropriate parameters, or some combination thereof.

For example, in various embodiments, the lock 715 may, for example, be Internet of Things (IoT) enabled. The lock 715 may, for example, identify a user who operates the lock 715 (e.g., biometric, card, user ID, RFID). The lock 715 may record and/or transmit to a remote logging module the user identity. An electronic access log may be maintained of operation of the lock 715. Accordingly, a user may identify who gained access to a cabinet associated with the lock. The user may inspect the access control units 110 to identify which user(s) took a specific asset 125 by identifying an identifying indicium 130 captured when the asset 125 was released. The user may then match, for example, against the electronic log to validate and/or determine who may have retrieved the asset 125.

Figure 8:
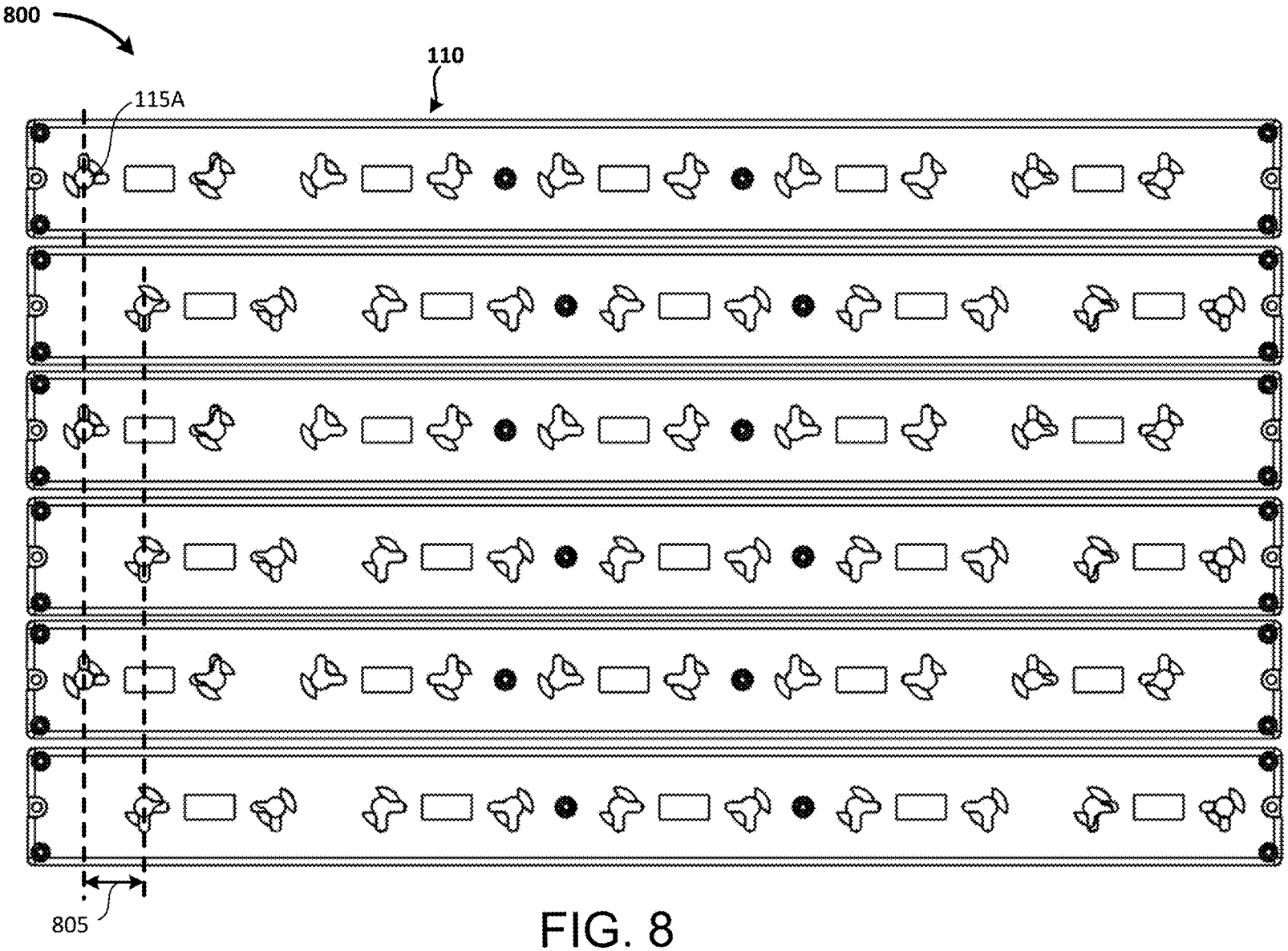
FIG. 8 depicts exemplary access control units 110 arranged in a stacking configuration with offset axes of symmetry.

FIG. 8 depicts exemplary access control units 110 arranged in a stacking configuration with offset axes of symmetry. In the depicted configuration 800, five pairs of access ports 115 are distributed along a longitudinal axis of each access control unit 110. The pairs of access ports 115 are offset from a center of the access control unit 110 along the longitudinal axis by a distance 805. Five access control units 110 are stacked such that their respective longitudinal axes are substantially parallel to one another, each access control unit 110 being rotated 180 degrees in the first plane relative to the previous access control unit 110 and/or the subsequent access control unit 110.

Accordingly, each access port 115A of each access control unit 110 is offset by the distance 805 from the access port 115 above and/or below it. Therefore, an object (e.g., a key) suspended from a peg in a particular access port 115 does not overhang an access port 115 in the access control unit 110 below it. Accordingly, a user may, by way of example and not limitation, advantageously view and/or locate a specific asset suspended from a peg in a specific access port 115 without having to move aside objects dangling from a peg 120 in an access unit above it.

In various embodiments, each access control unit 110 may be assembled in one of two assembly configurations as described at least with reference to FIGS. 4A-4B. For example, the interlocking mechanism 140 may be disposed within each carrier 310 and/or housing 305 such that the interlocking mechanism is always aligned with moon gear 145A on the left, but the access control unit 110 is aligned with a larger gap (by offset distance 805) on the left or on the right. Accordingly, a single set of components may be configured to assemble alternatingly offset access control unit 110 assemblies.

Figure 9A:
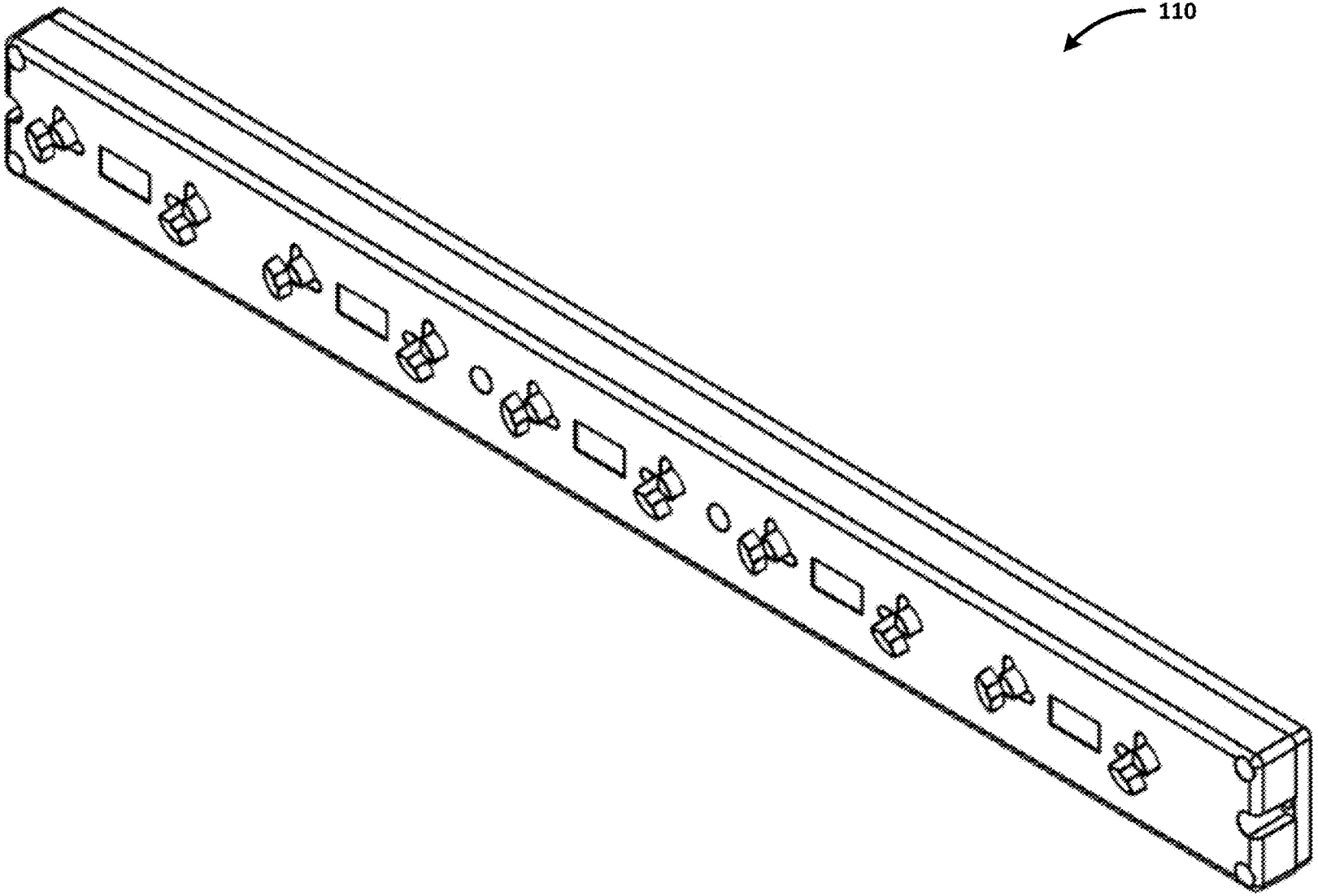
FIG. 9A, FIG. 9B, FIG. 9C, FIG. 9D, FIG. 9E, FIG. 9F, and FIG. 9G depict views of the exemplary access control unit 110.
Figure 9C:
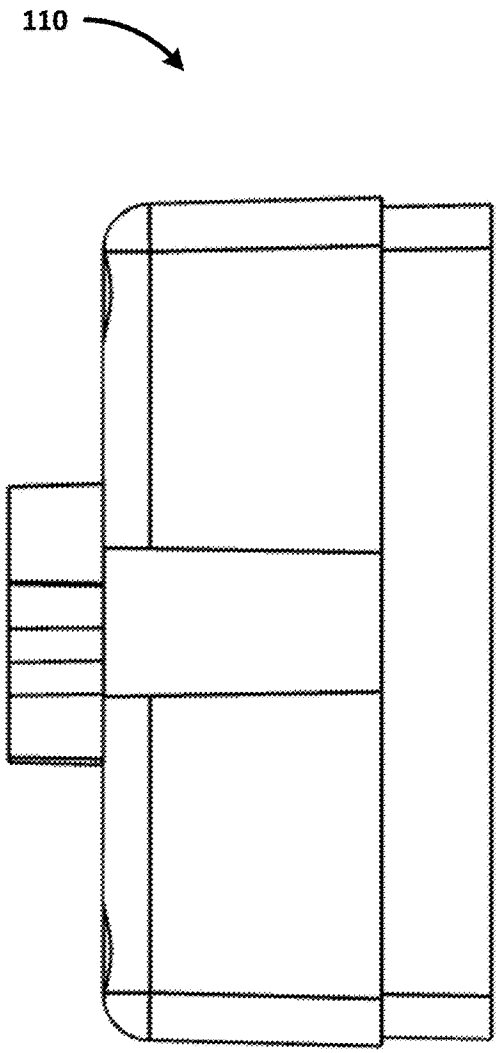
Figure 9B:
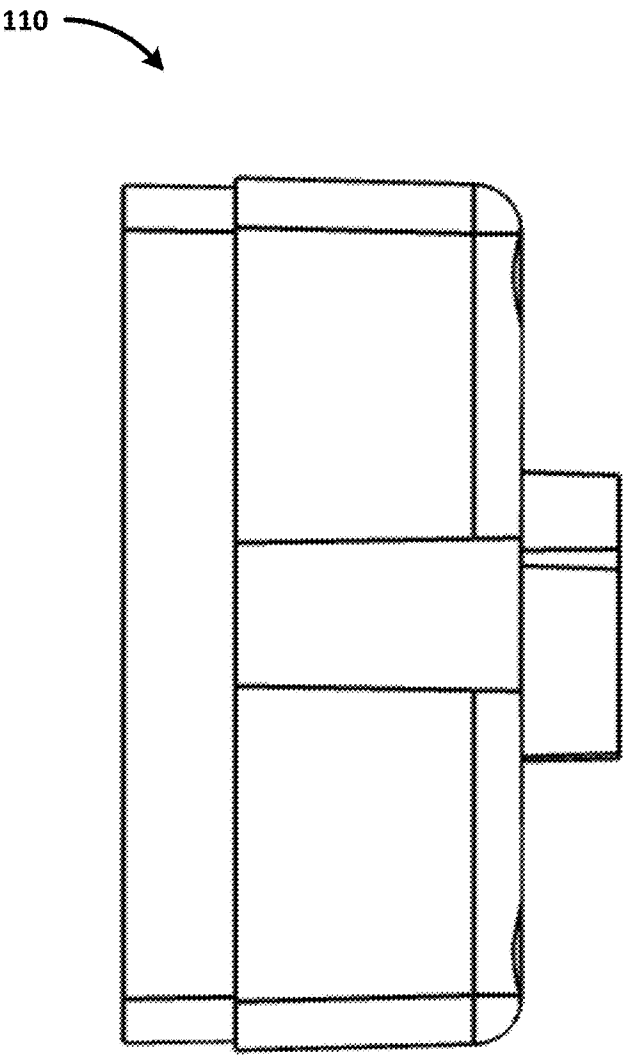
Figure 9D:
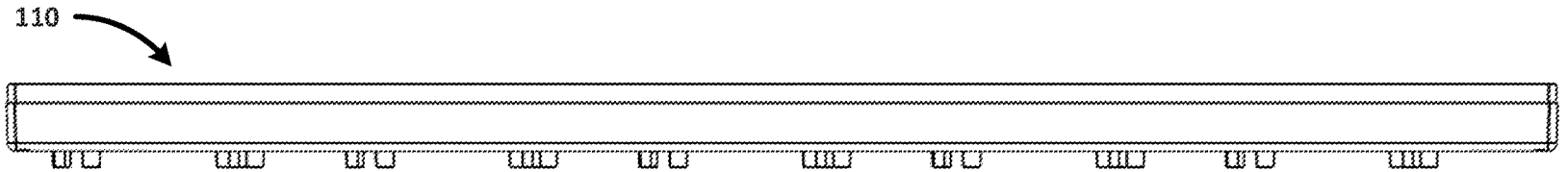
Figure 9E:
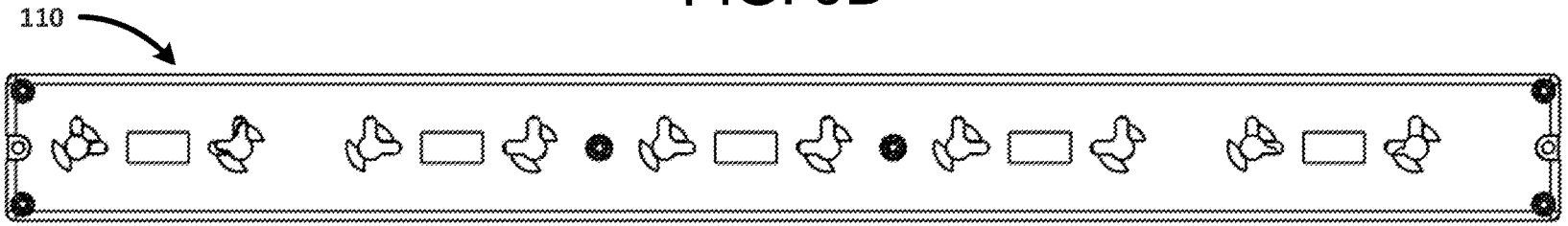
Figure 9F:
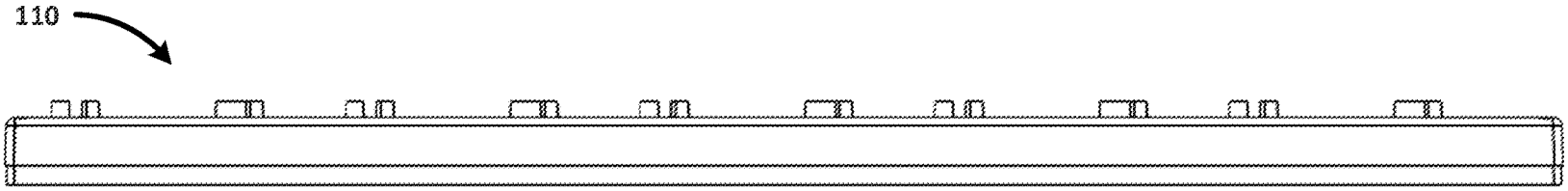
Figure 9G:
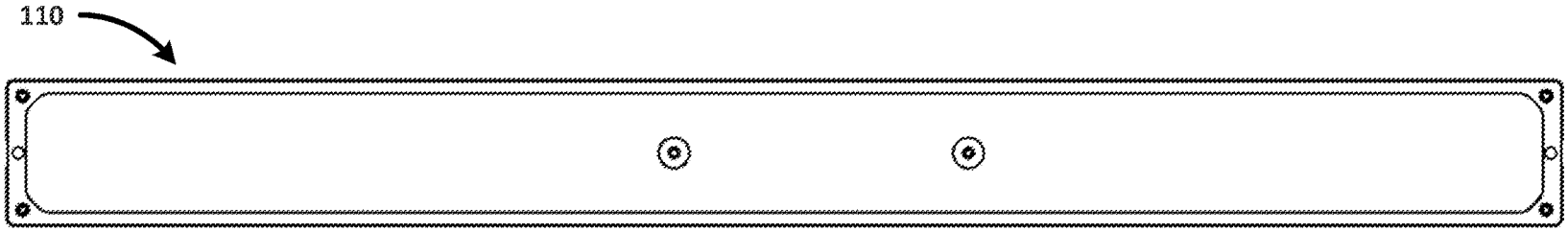

FIG. 9A, FIG. 9B, FIG. 9C, FIG. 9D, FIG. 9E, FIG. 9F, and FIG. 9G depict views of the exemplary access control unit 110. FIG. 9A depicts a perspective view of the exemplary access control unit 110. FIG. 9B depicts a left elevation view of the access control unit 110. FIG. 9C depicts a right elevation view of the access control unit 110. FIG. 9D depicts a top plan view of the access control unit 110. FIG. 9E depicts a front elevation view of the access control unit 110. FIG. 9F depicts a bottom plan view of the access control unit 110. FIG. 9G depicts a rear elevation view of the access control unit 110.

Figure 10A:
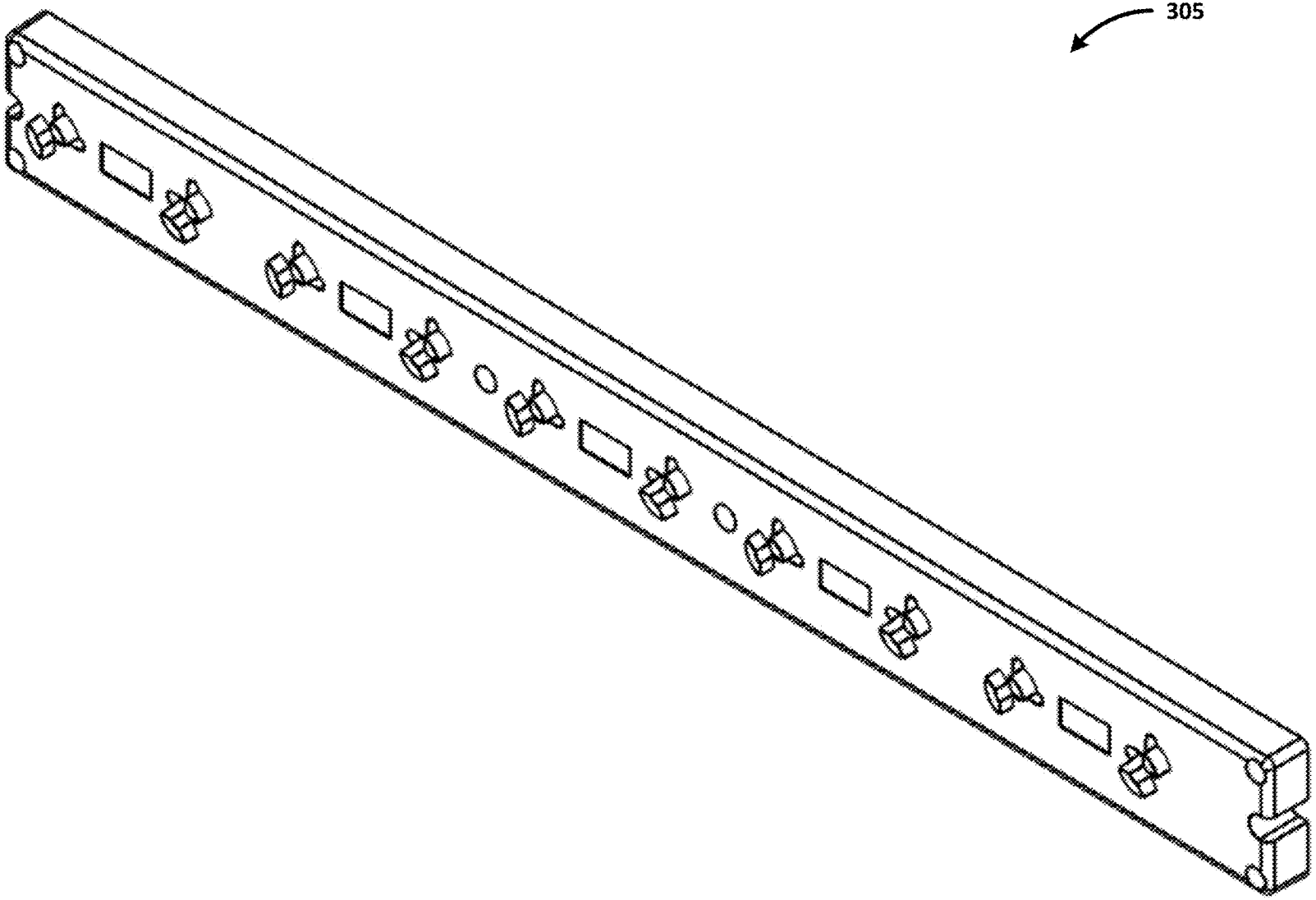
FIG. 10A, FIG. 10B, FIG. 10C, FIG. 10D, FIG. 10E, FIG. 10F, and FIG. 10G depict views of an exemplary housing cover 305 of the exemplary access control unit 110.
Figure 10C:
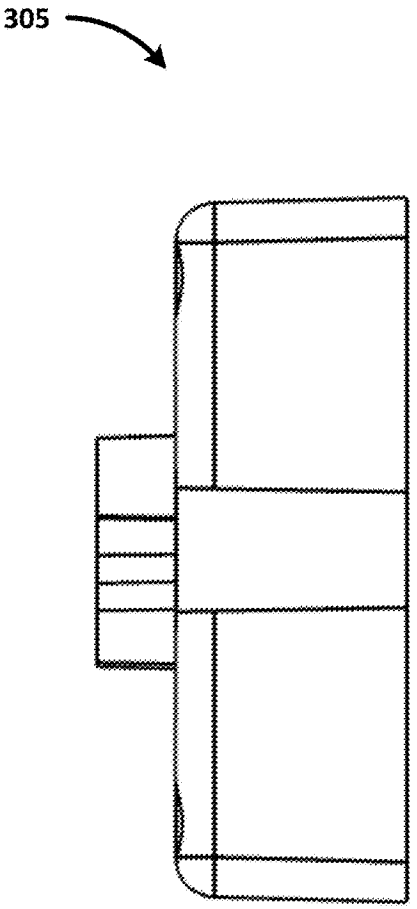
Figure 10B:
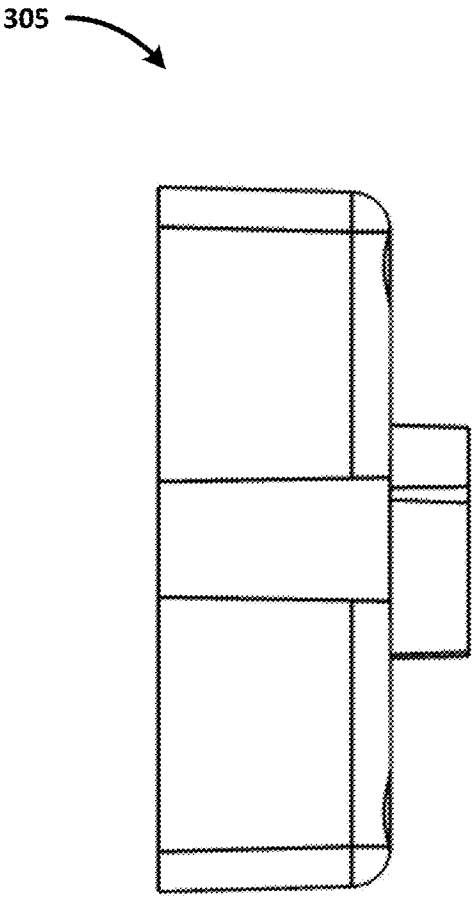
Figure 10D:
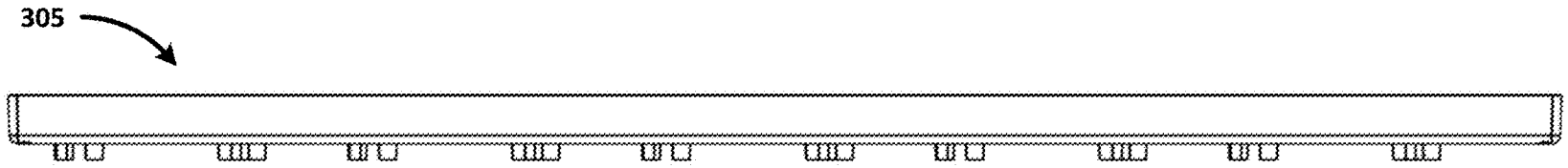
Figure 10E:
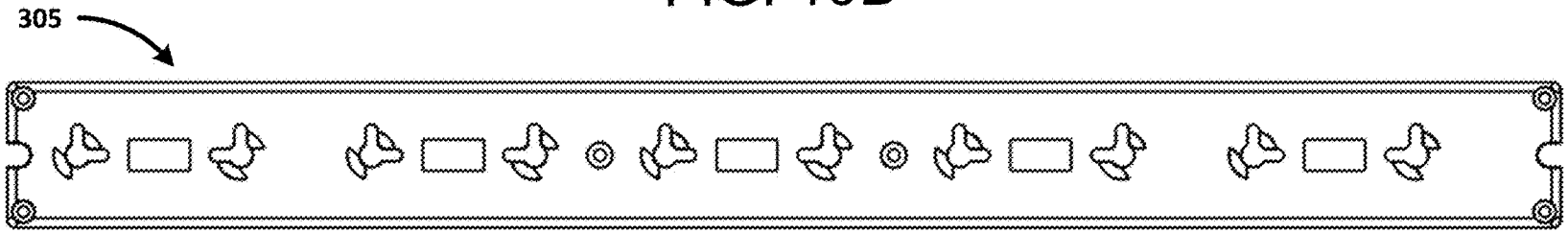
Figure 10F:
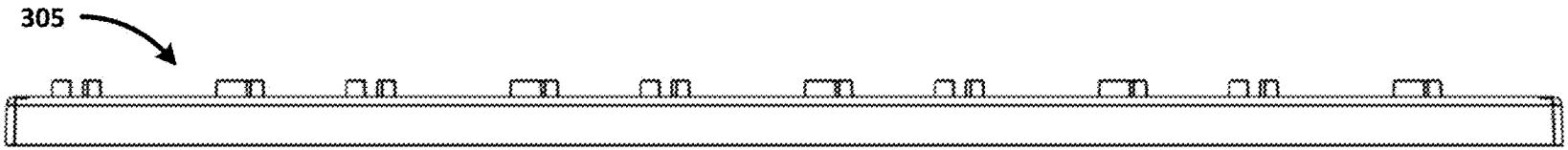
Figure 10G:
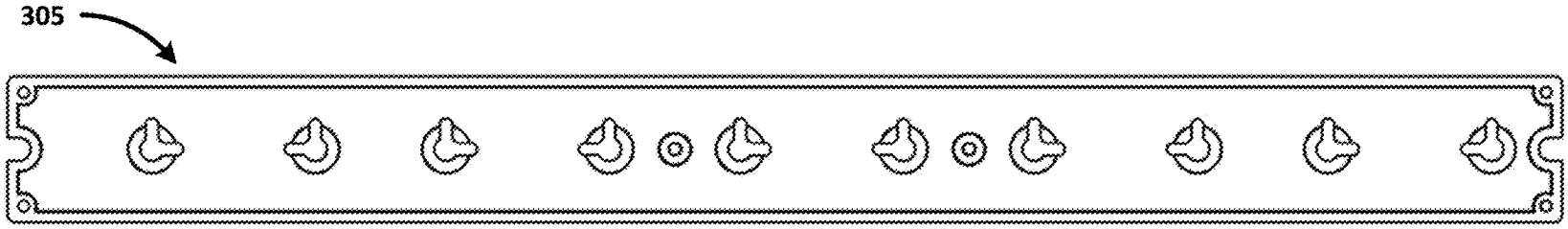

FIG. 10A, FIG. 10B, FIG. 10C, FIG. 10D, FIG. 10E, FIG. 10F, and FIG. 10G depict views of an exemplary housing cover 305 of the exemplary access control unit 110. FIG. 10A depicts a perspective view of the exemplary housing cover 305. FIG. 10B depicts a left elevation view of the housing cover 305. FIG. 10C depicts a right elevation view of the housing cover 305. FIG. 10D depicts a top plan view of the housing cover 305. FIG. 10E depicts a front elevation view of the housing cover 305. FIG. 10F depicts a bottom plan view of the housing cover 305. FIG. 10G depicts a rear elevation view of the housing cover 305.

Figure 11A:
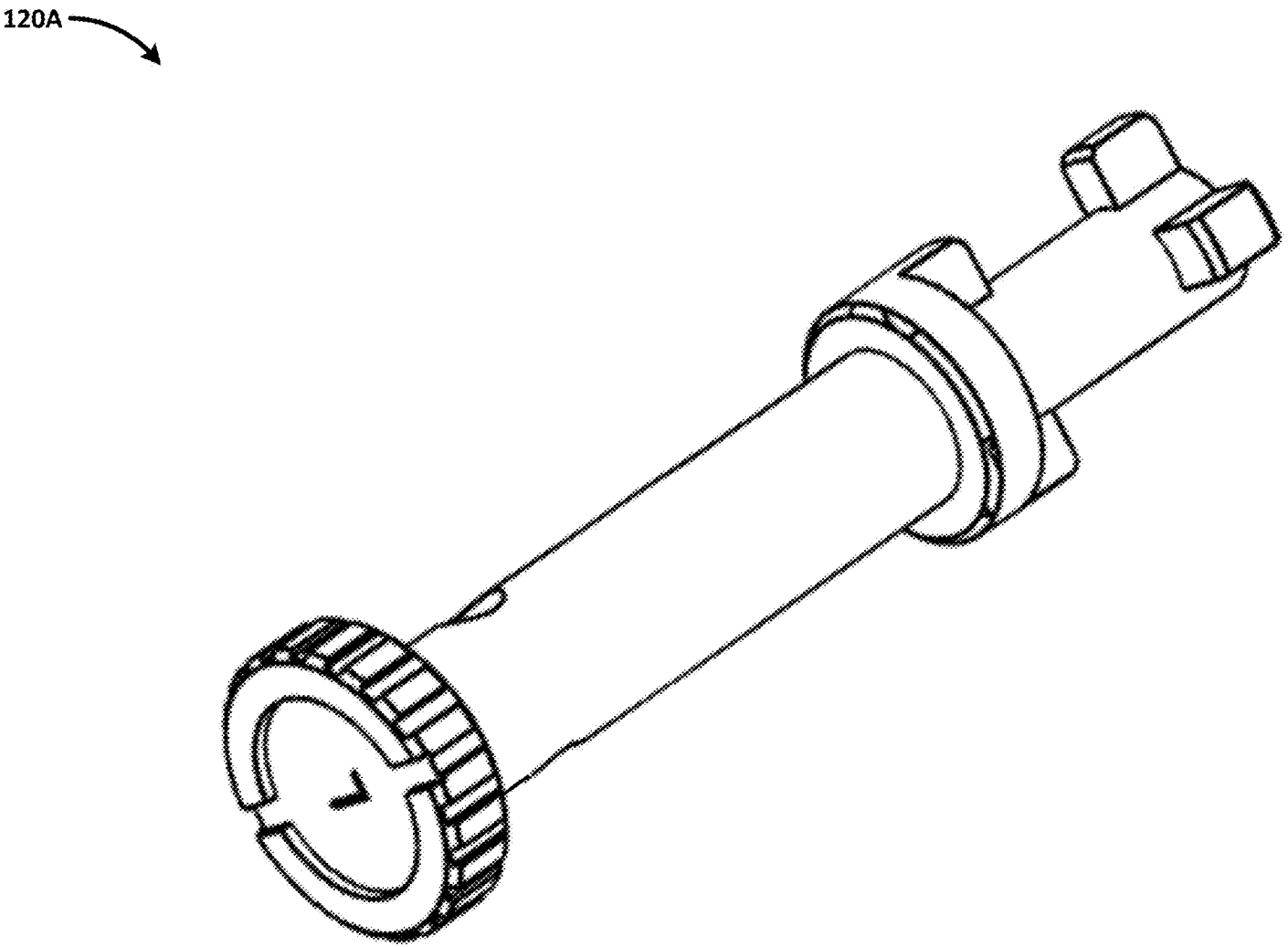
FIG. 11A, FIG. 11B, FIG. 11C, FIG. 11D, FIG. 11E, FIG. 11F, and FIG. 11G depict views of an exemplary first peg 120A of the exemplary access control unit 110.
Figure 11C:
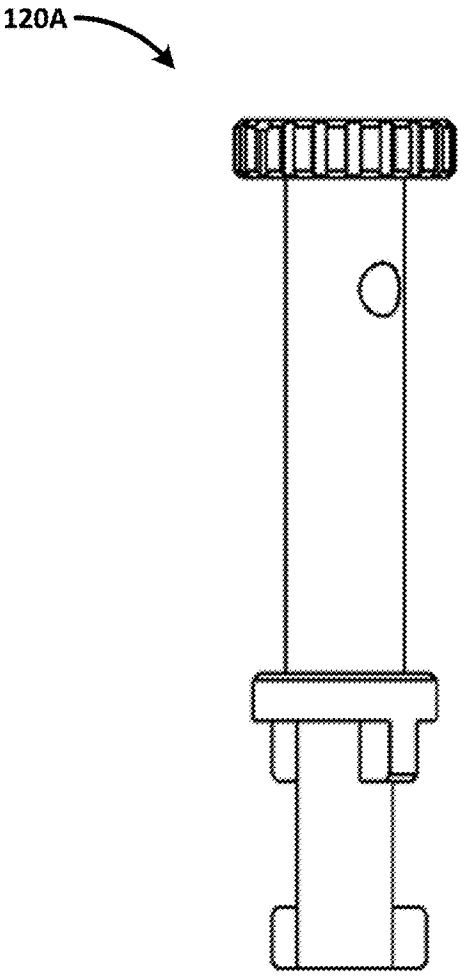
Figure 11B:
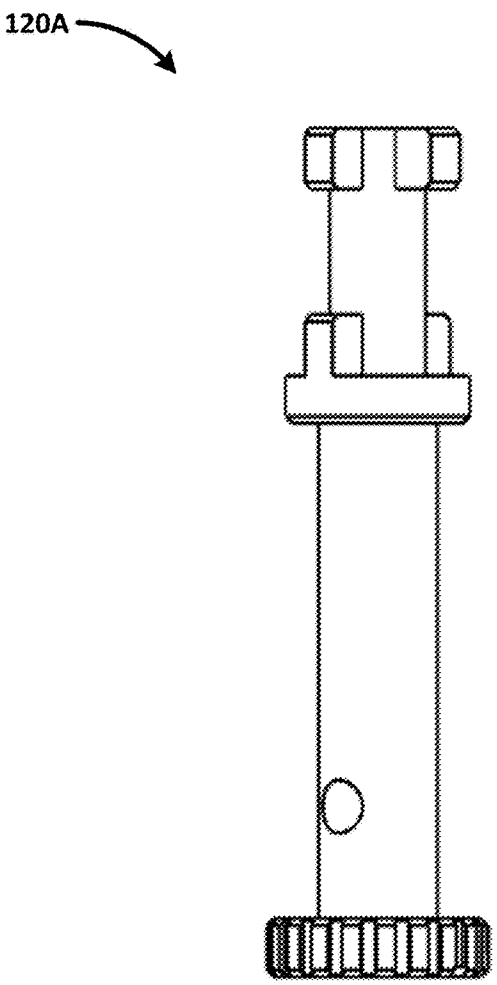
Figure 11D:
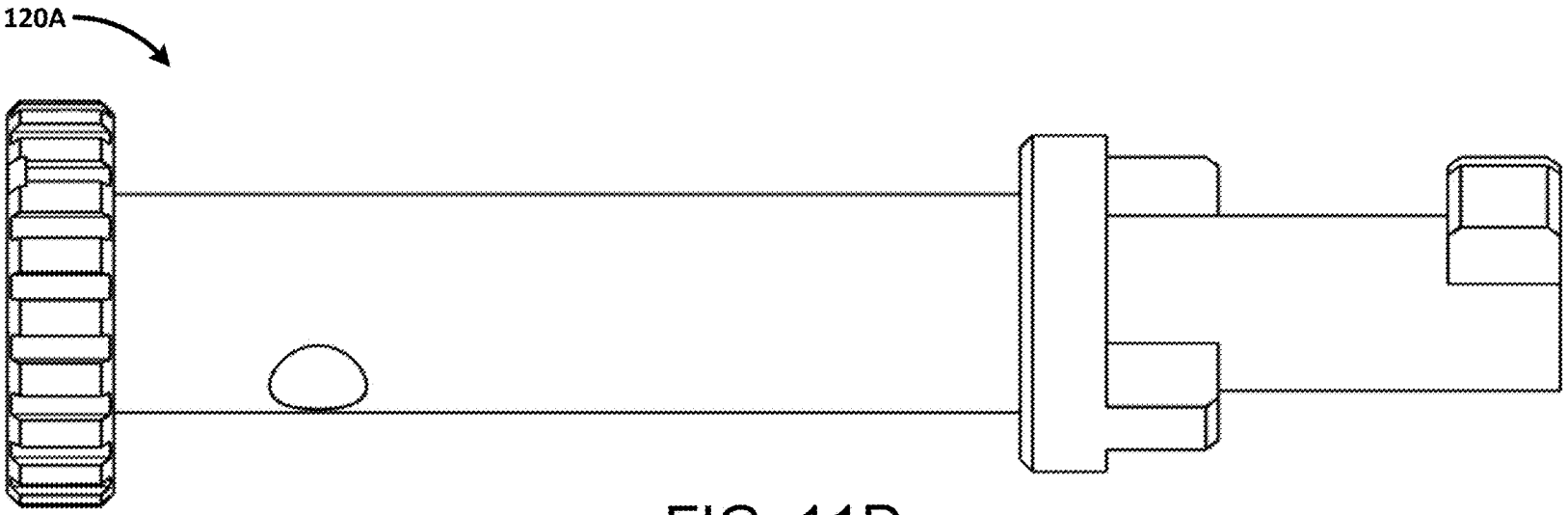
Figure 11E:
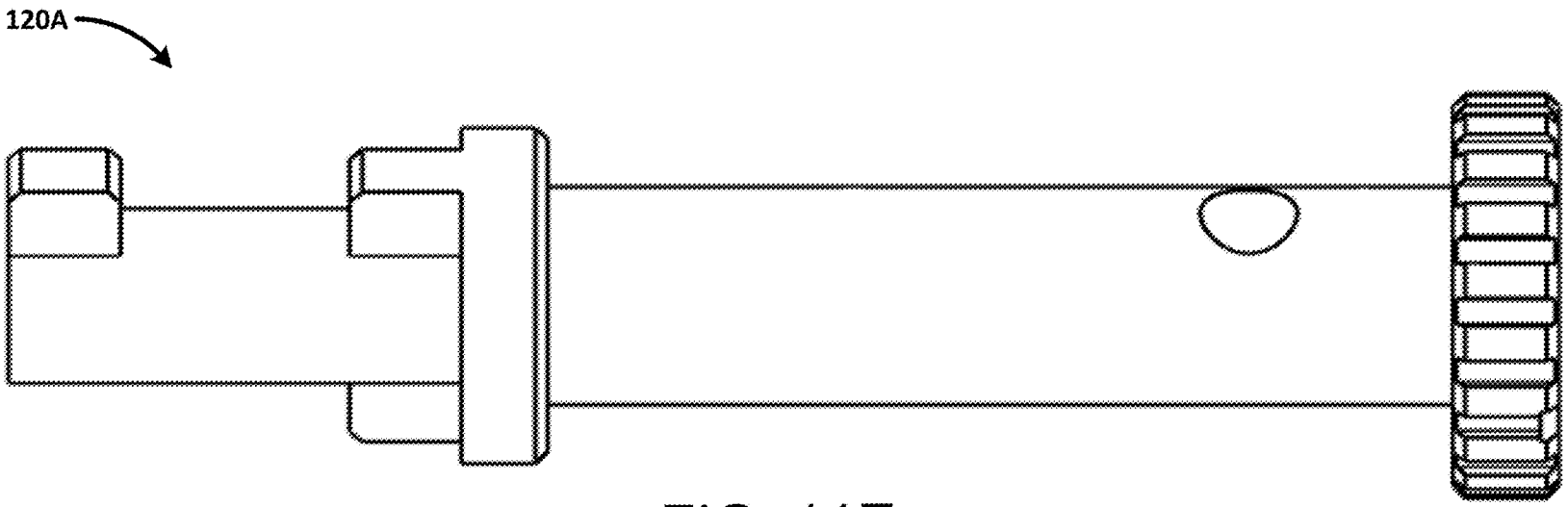
Figure 11G:
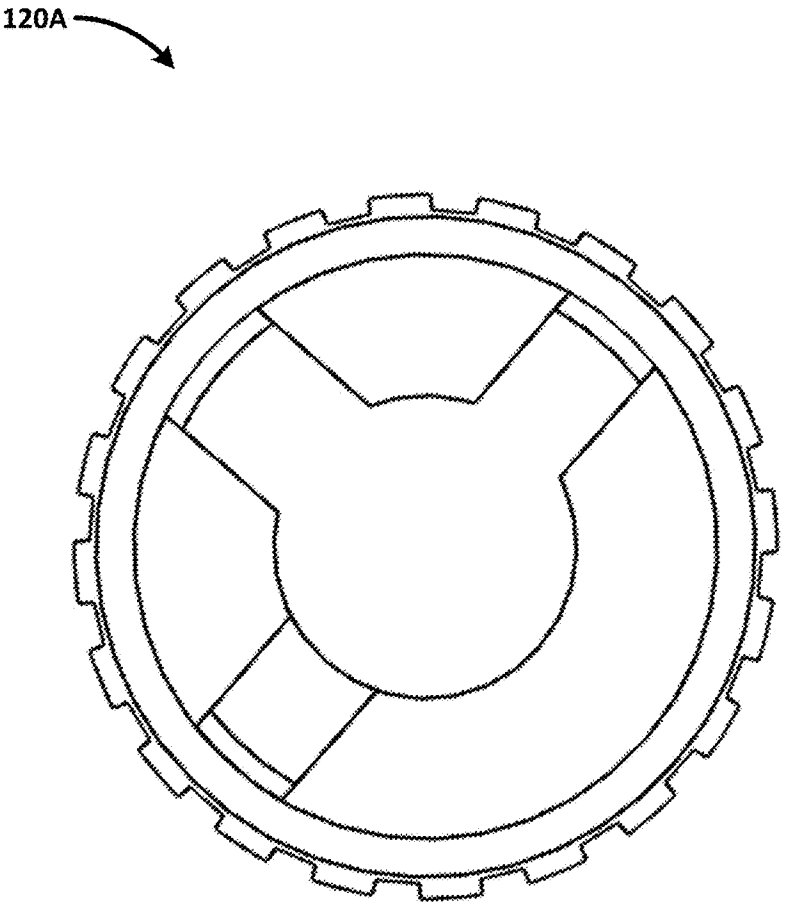
Figure 11F:
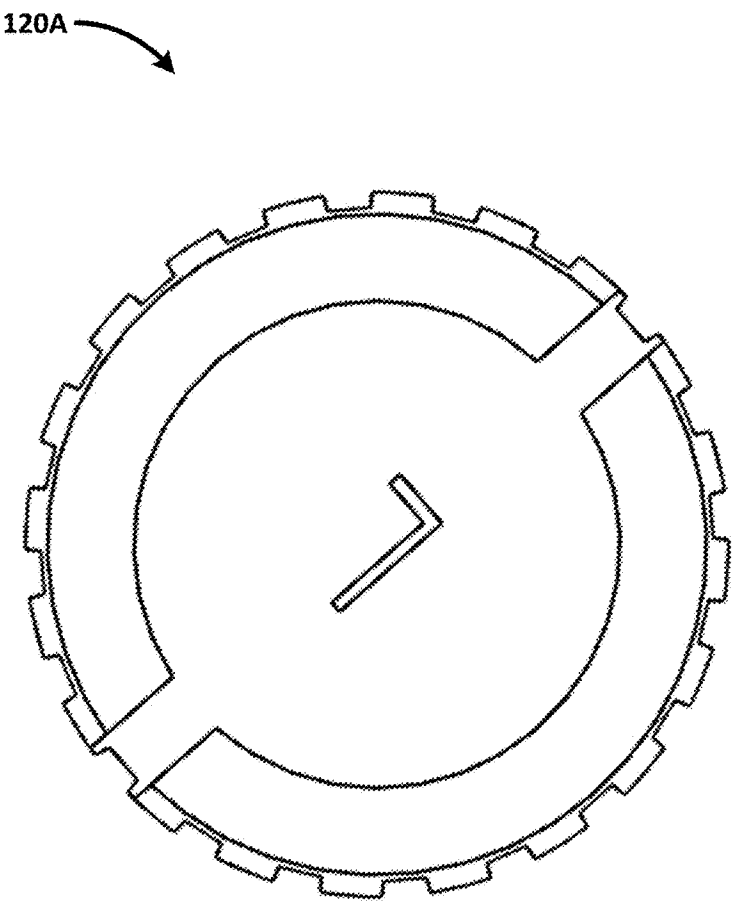

FIG. 11A, FIG. 11B, FIG. 11C, FIG. 11D, FIG. 11E, FIG. 11F, and FIG. 11G depict views of an exemplary first peg 120A of the exemplary access control unit 110. FIG. 11A depicts a perspective view of the exemplary first peg 120A. FIG. 11B depicts a left elevation view of the first peg 120A. FIG. 11C depicts a right elevation view of the first peg 120A. FIG. 11D depicts a top plan view of the first peg 120A. FIG. 11E depicts a front elevation view of the first peg 120A. FIG. 11F depicts a bottom plan view of the first peg 120A. FIG. 11G depicts a rear elevation view of the first peg 120A.

Figure 12A:
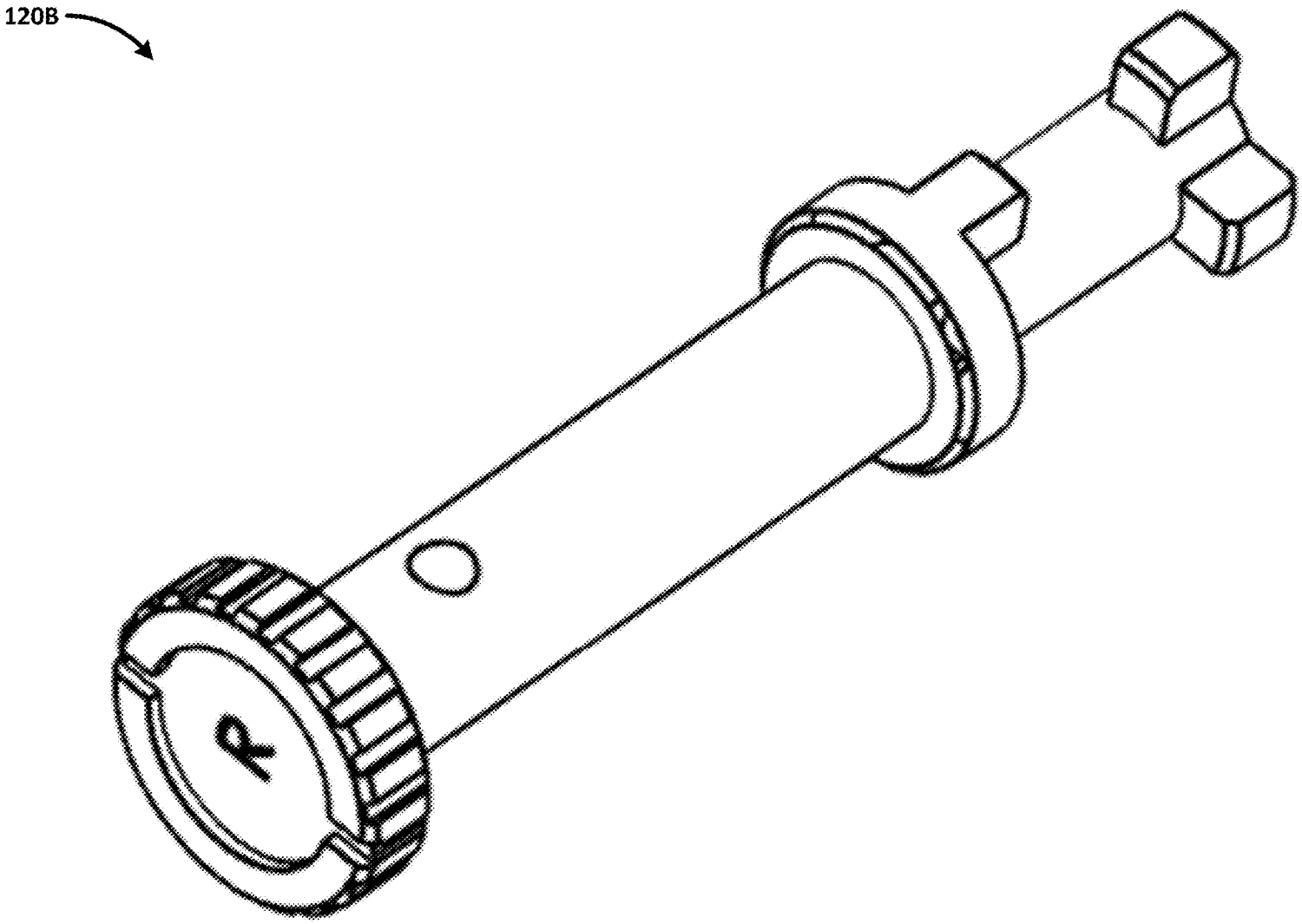
FIG. 12A, FIG. 12B, FIG. 12C, FIG. 12D, FIG. 12E, FIG. 12F, and FIG. 12G depict views of an exemplary second peg 120B of the exemplary access control unit 110.
Figure 12C:
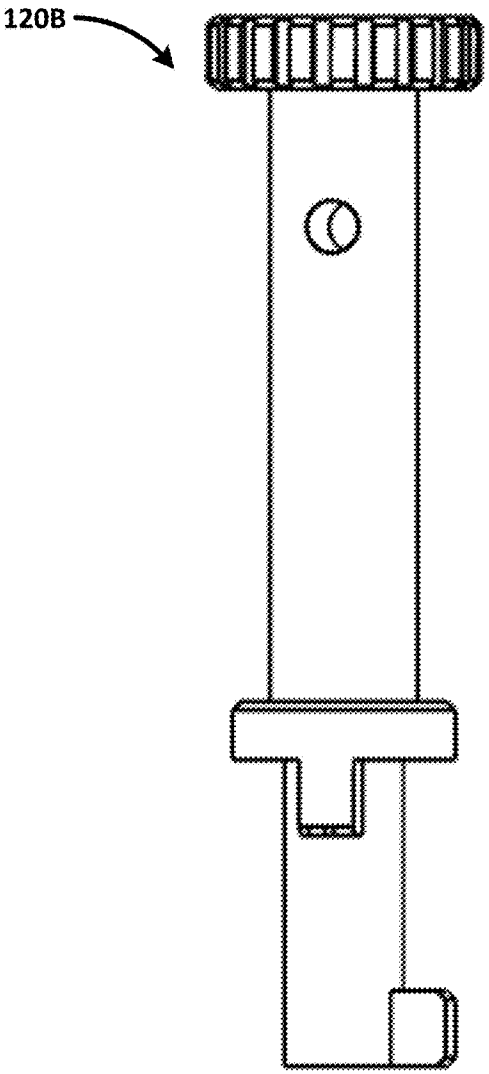
Figure 12B:
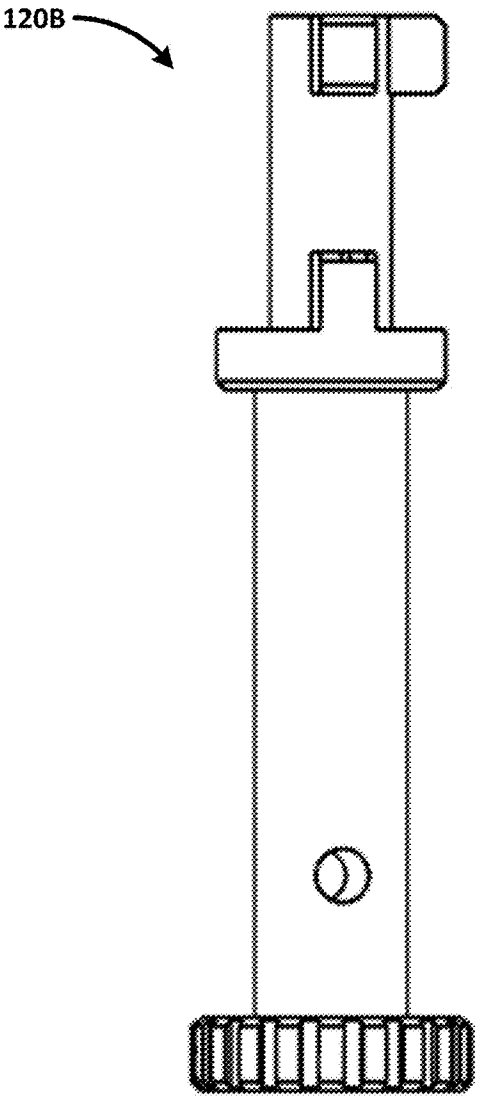
Figure 12D:
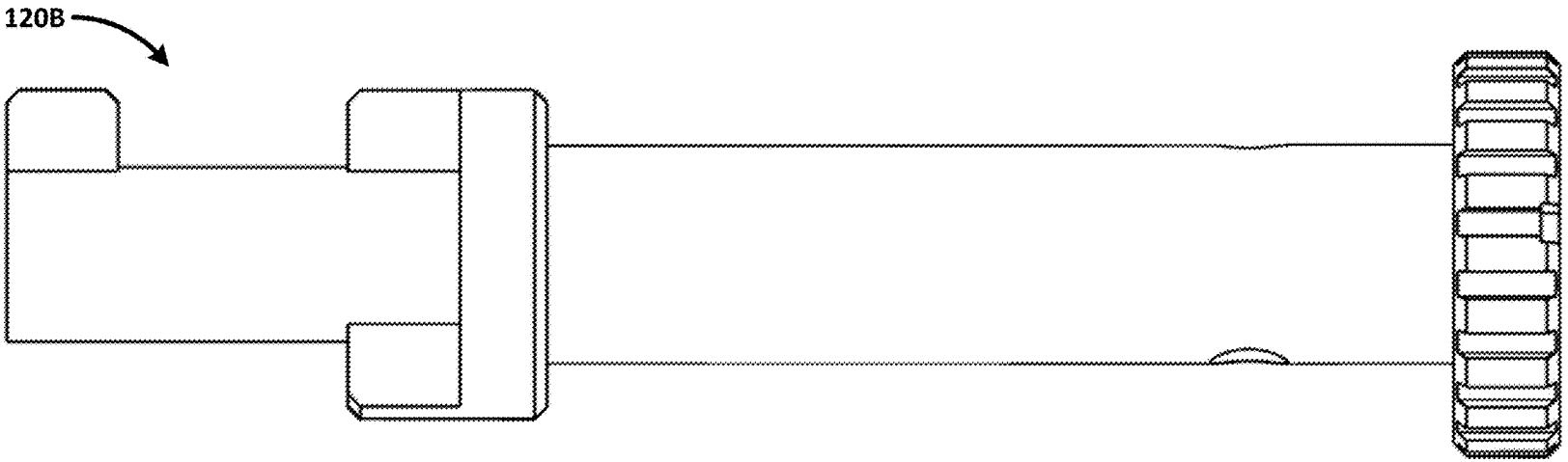
Figure 12E:
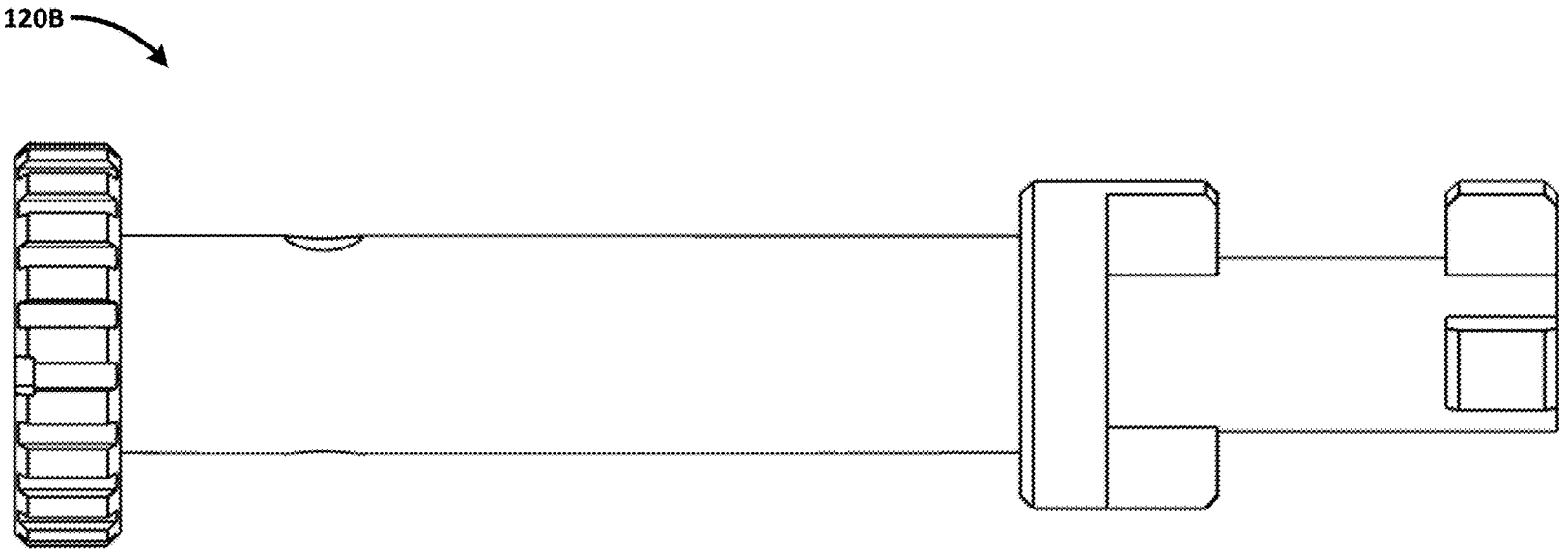
Figure 12G:
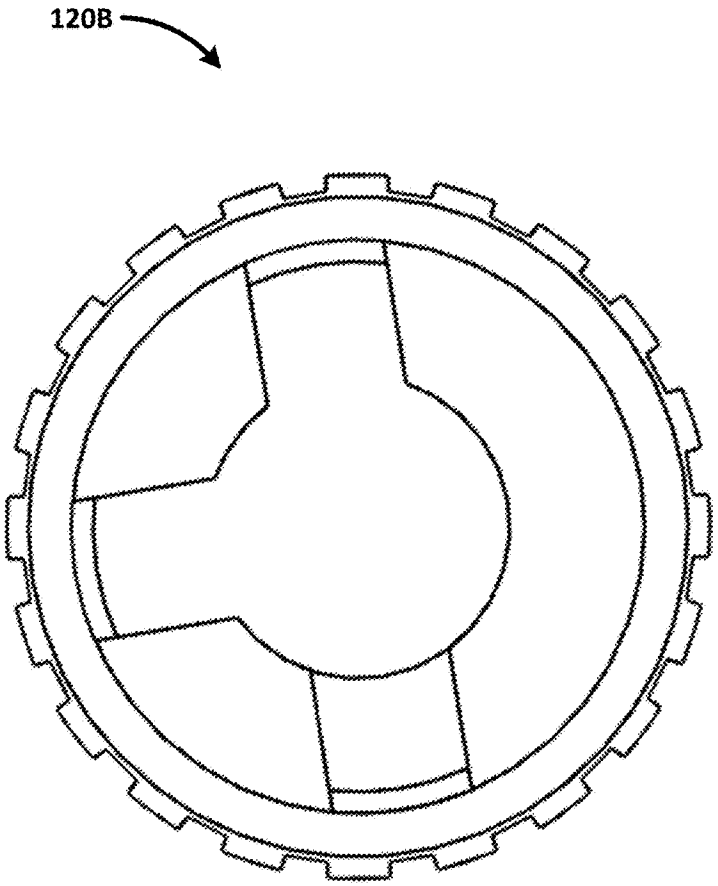
Figure 12F:
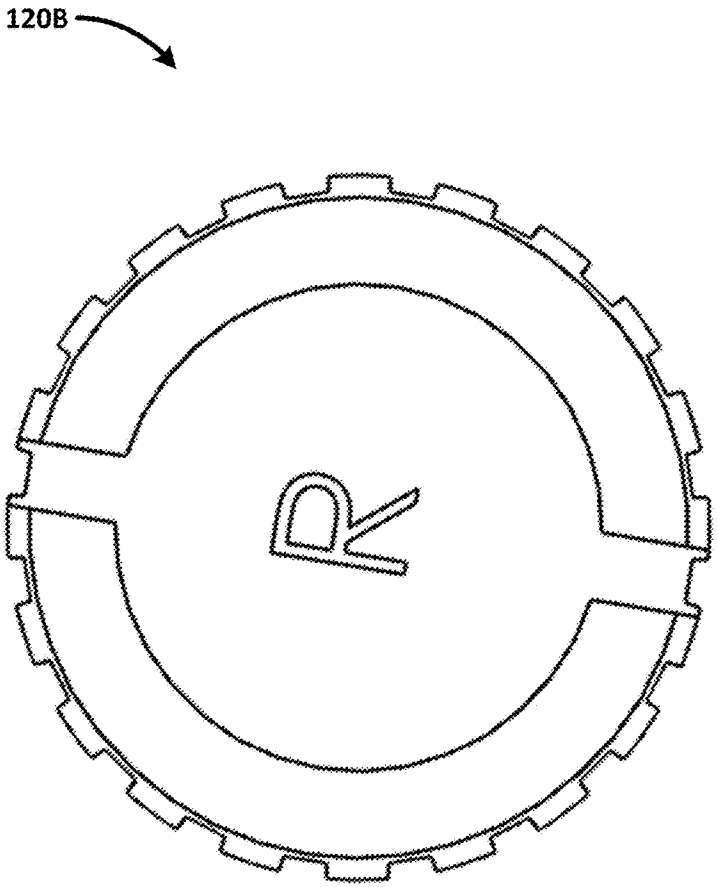

FIG. 12A, FIG. 12B, FIG. 12C, FIG. 12D, FIG. 12E, FIG. 12F, and FIG. 12G depict views of an exemplary second peg 120B of the exemplary access control unit 110. FIG. 12A depicts a perspective view of the exemplary second peg 120B. FIG. 12B depicts a left elevation view of the second peg 120B. FIG. 12C depicts a right elevation view of the second peg 120B. FIG. 12D depicts a top plan view of the second peg 120B. FIG. 12E depicts a front elevation view of the second peg 120B. FIG. 12F depicts a bottom plan view of the second peg 120B. FIG. 12G depicts a rear elevation view of the second peg 120B.

Figure 13A:
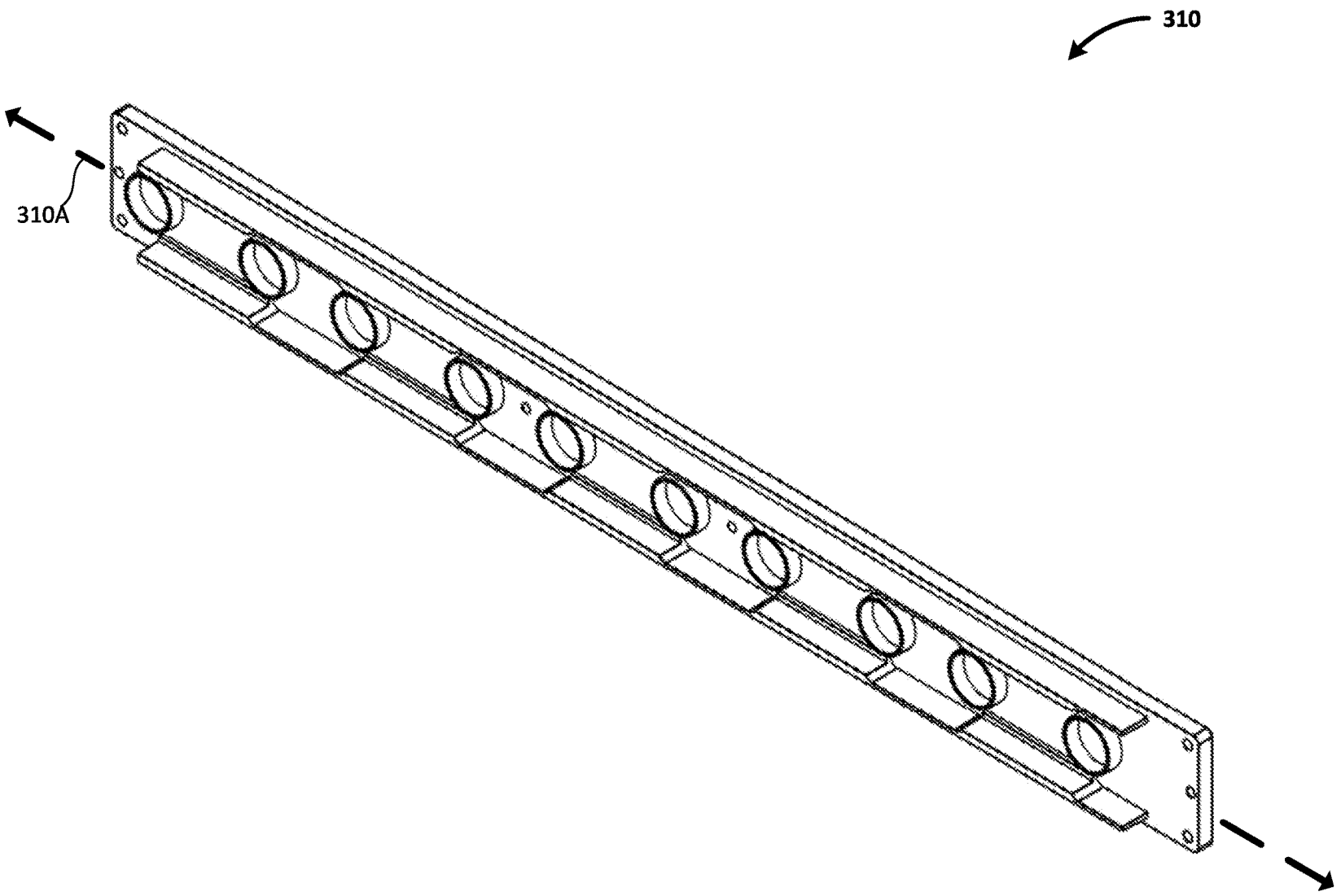
FIG. 13A, FIG. 13B, FIG. 13C, FIG. 13D, FIG. 13E, FIG. 13F, and FIG. 13G depict views of an exemplary carrier 310 of the exemplary access control unit 110.
Figure 13C:
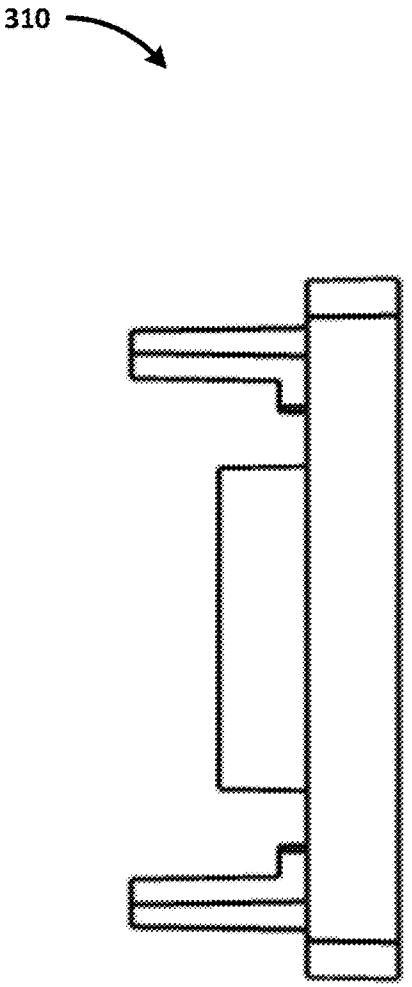
Figure 13B:
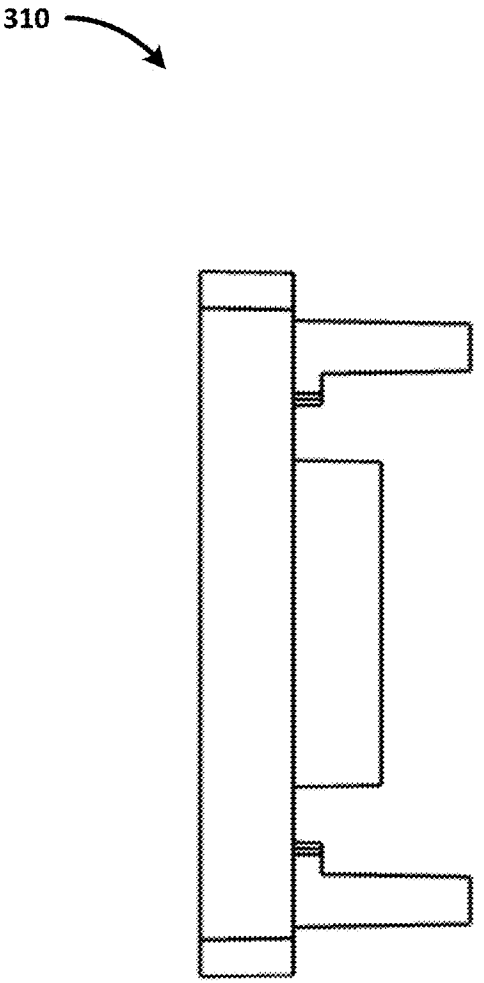
Figure 13D:
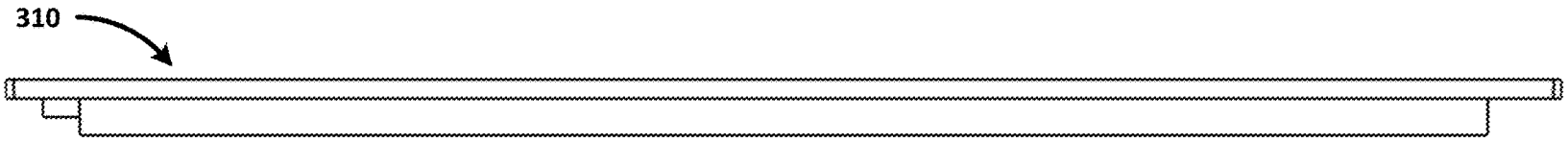
Figure 13E:
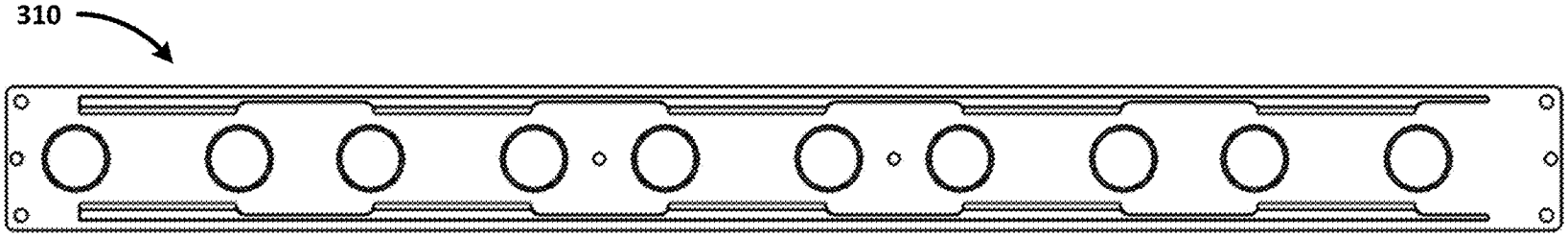
Figure 13F:
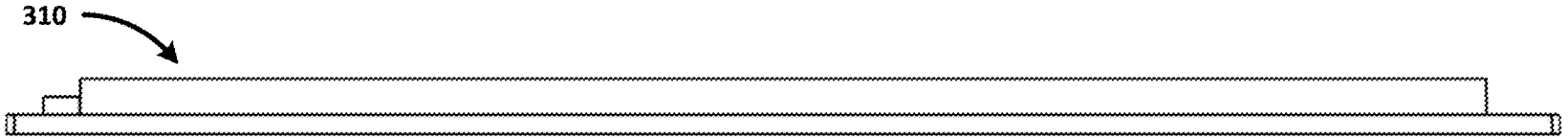
Figure 13G:
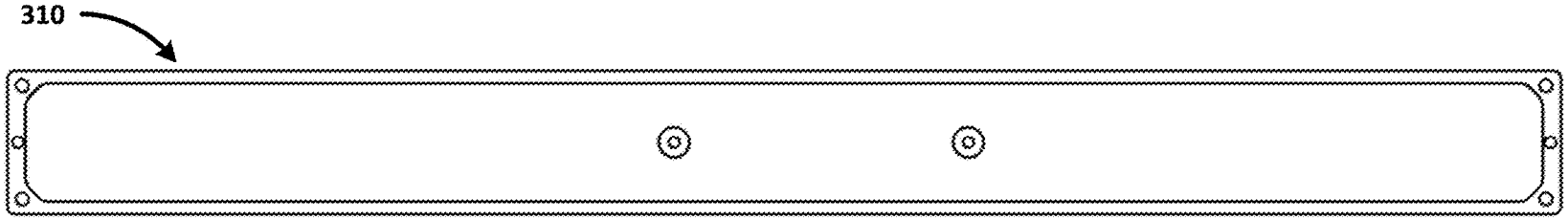

FIG. 13A, FIG. 13B, FIG. 13C, FIG. 13D, FIG. 13E, FIG. 13F, and FIG. 13G depict views of an exemplary carrier 310 of the exemplary access control unit 110. FIG. 13A depicts a perspective view of the exemplary carrier 310. FIG. 13B depicts a left elevation view of the carrier 310. FIG. 13C depicts a right elevation view of the carrier 310. FIG. 13D depicts a top plan view of the carrier 310. FIG. 13E depicts a front elevation view of the carrier 310. FIG. 13F depicts a bottom plan view of the carrier 310. FIG. 13G depicts a rear elevation view of the carrier 310.

Figure 14A:
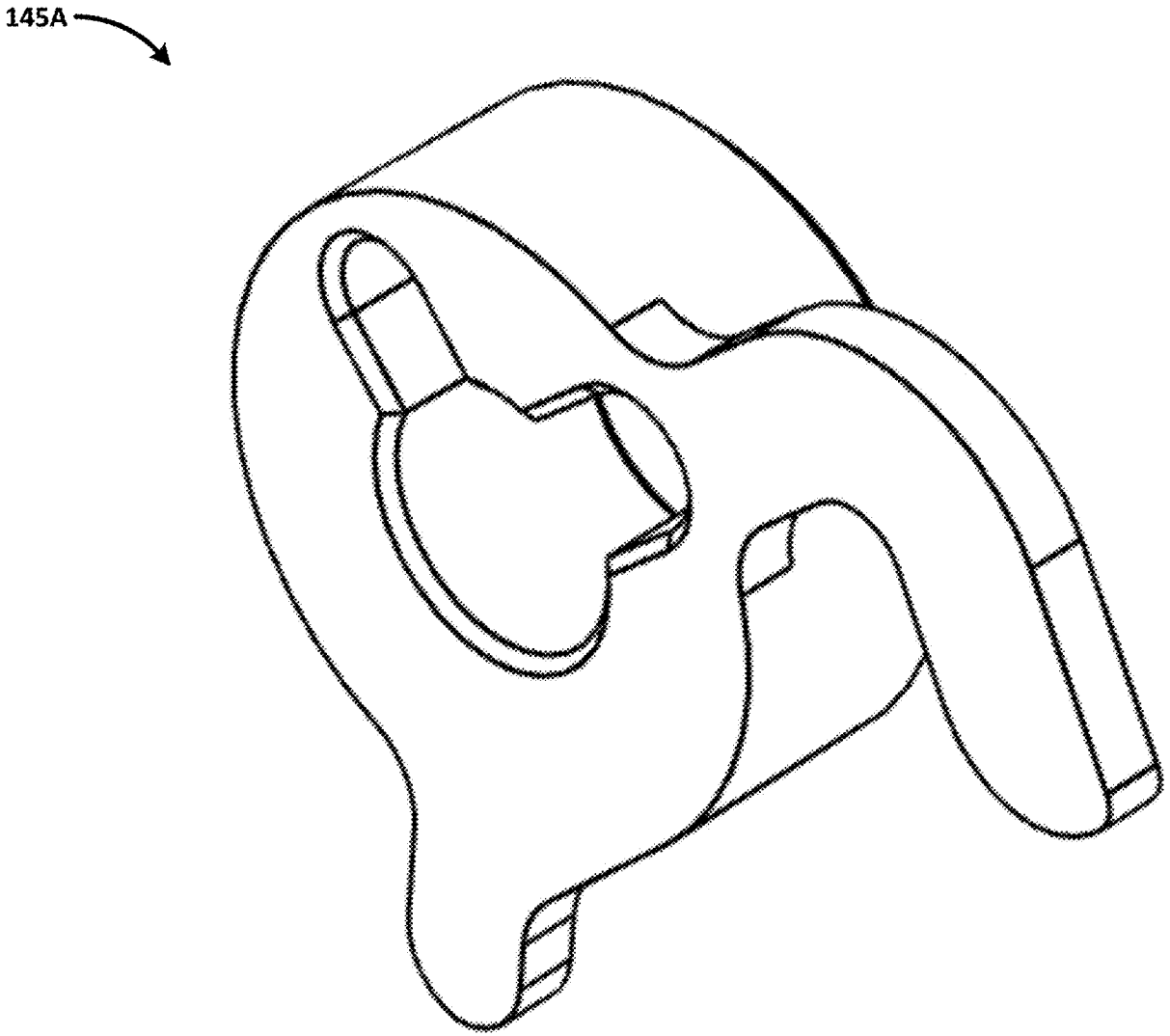
FIG. 14A, FIG. 14B, FIG. 14C, FIG. 14D, FIG. 14E, FIG. 14F, and FIG. 14G depict views of an exemplary first moon gear 145A of the exemplary access control unit 110.
Figure 14C:
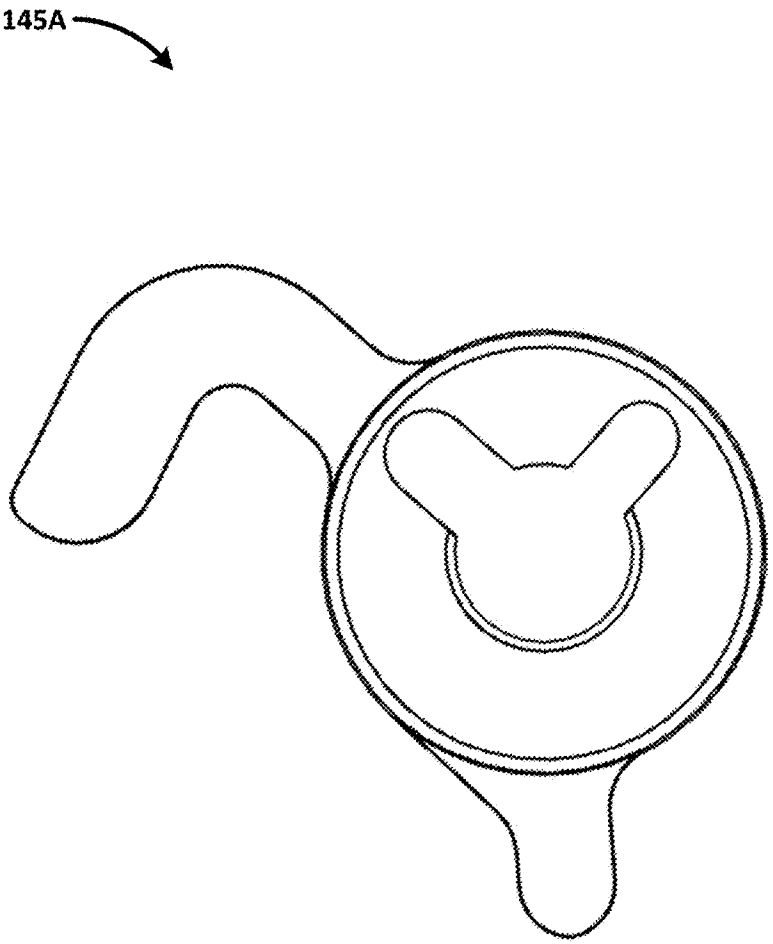
Figure 14B:
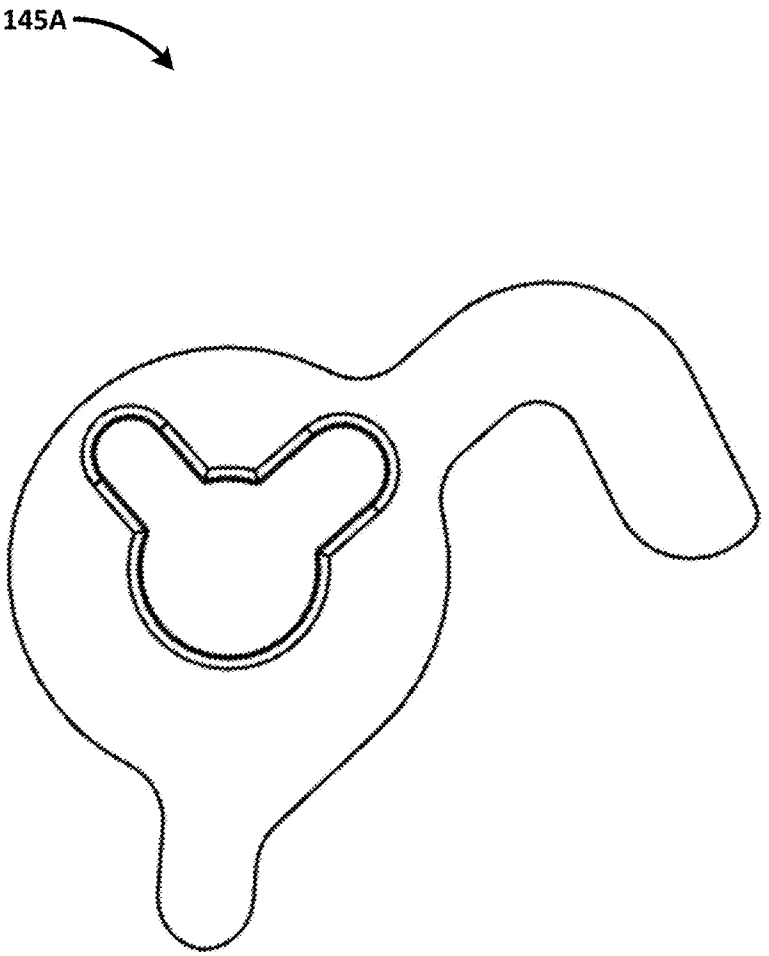
Figure 14E:
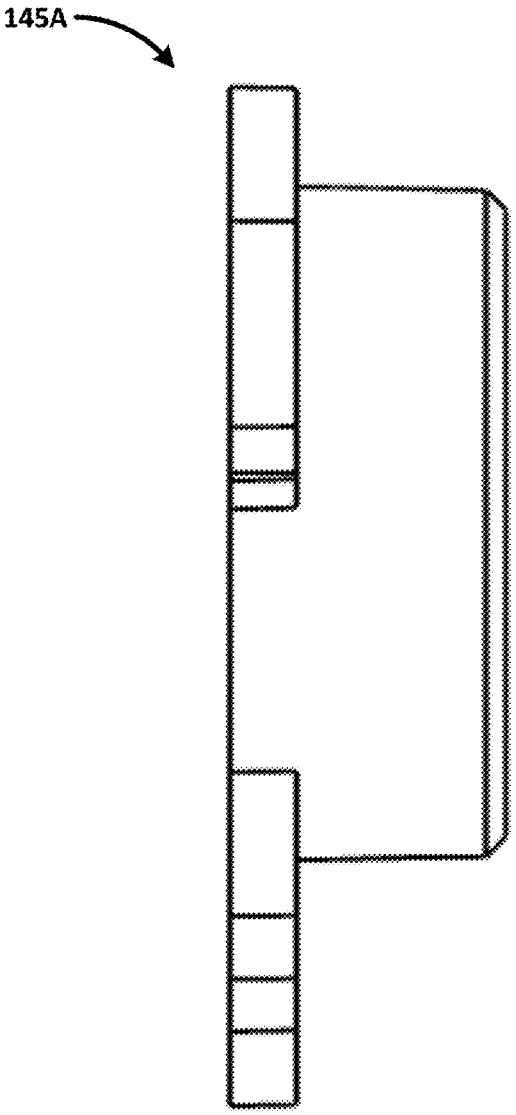
Figure 14D:
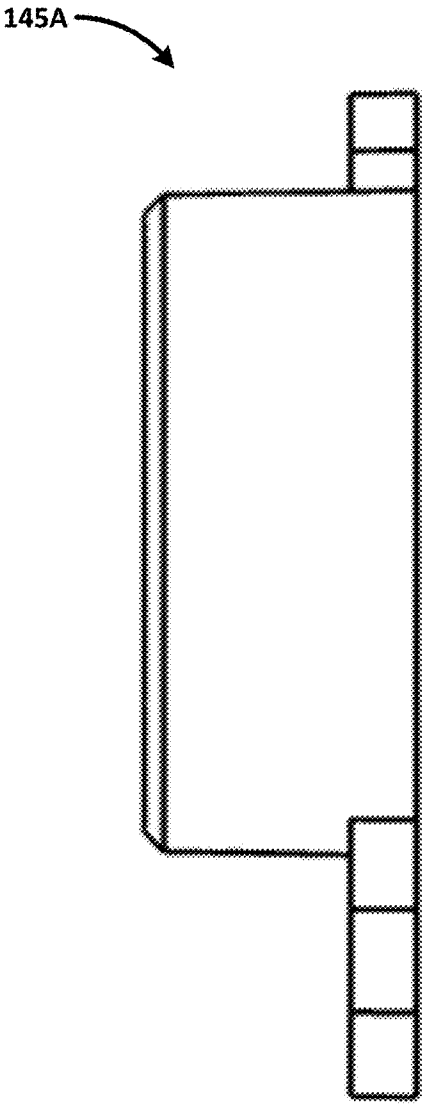
Figure 14F:
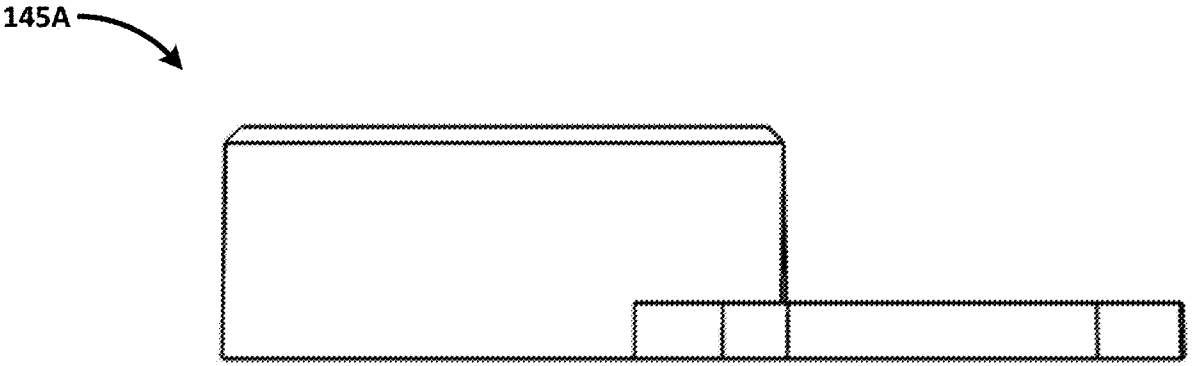
Figure 14G:
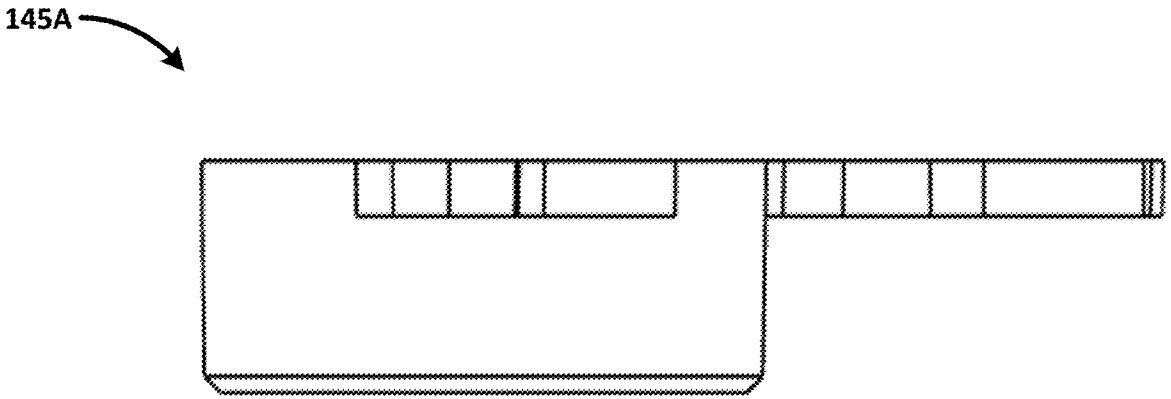

FIG. 14A, FIG. 14B, FIG. 14C, FIG. 14D, FIG. 14E, FIG. 14F, and FIG. 14G depict views of an exemplary first moon gear 145A of the exemplary access control unit 110. FIG. 14A depicts a perspective view of the exemplary first moon gear 145A. FIG. 14B depicts a left elevation view of the first moon gear 145A. FIG. 14C depicts a right elevation view of the first moon gear 145A. FIG. 14D depicts a top plan view of the first moon gear 145A. FIG. 14E depicts a front elevation view of the first moon gear 145A. FIG. 14F depicts a bottom plan view of the first moon gear 145A. FIG. 14G depicts a rear elevation view of the first moon gear 145A.

Figure 15A:
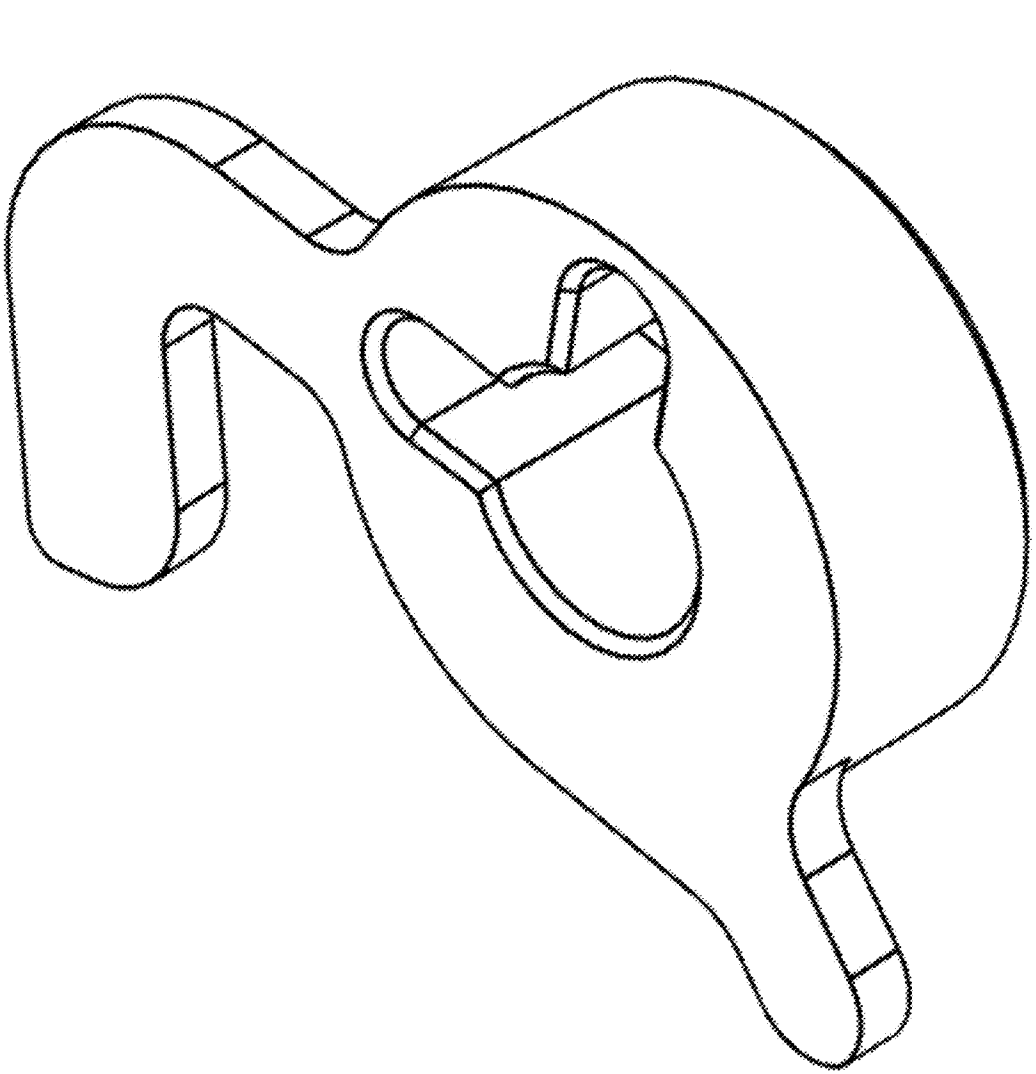
FIG. 15A, FIG. 15B, FIG. 15C, FIG. 15D, FIG. 15E, FIG. 15F, and FIG. 15G depict views of an exemplary second moon gear 145B of the exemplary access control unit 110.
Figure 15C:
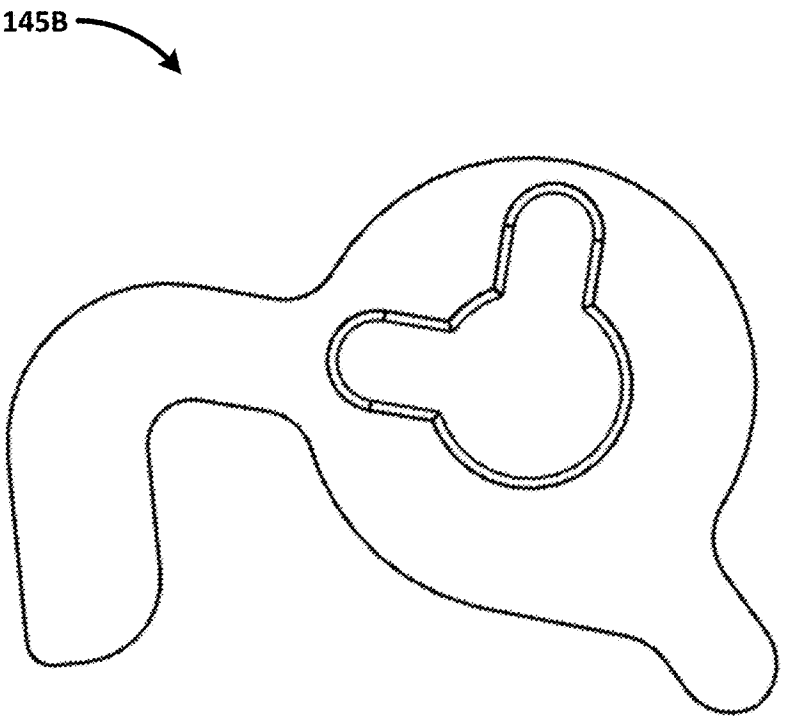
Figure 15B:
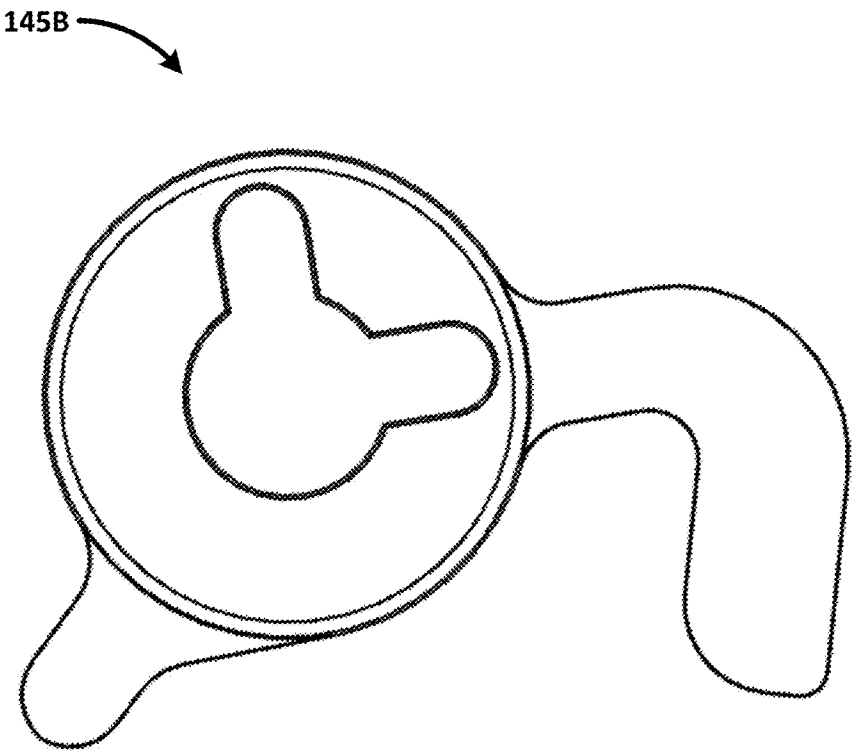
Figure 15E:
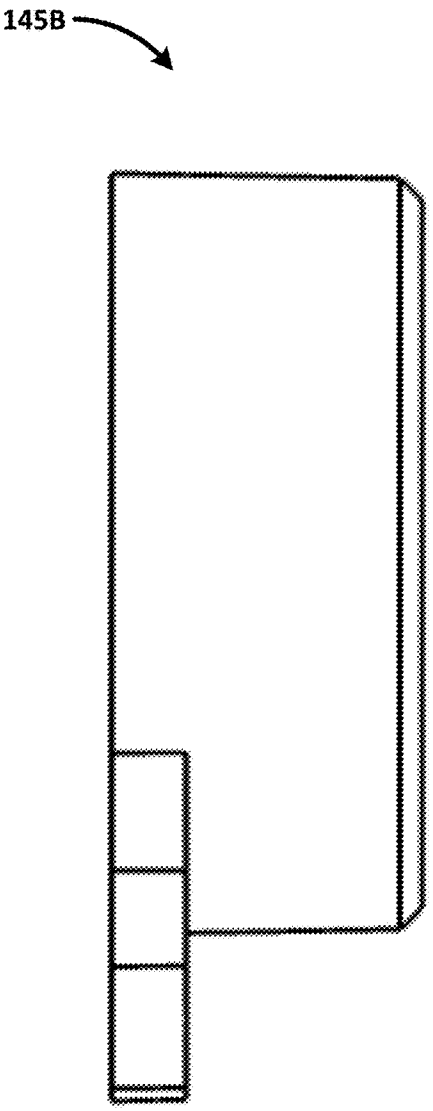
Figure 15D:
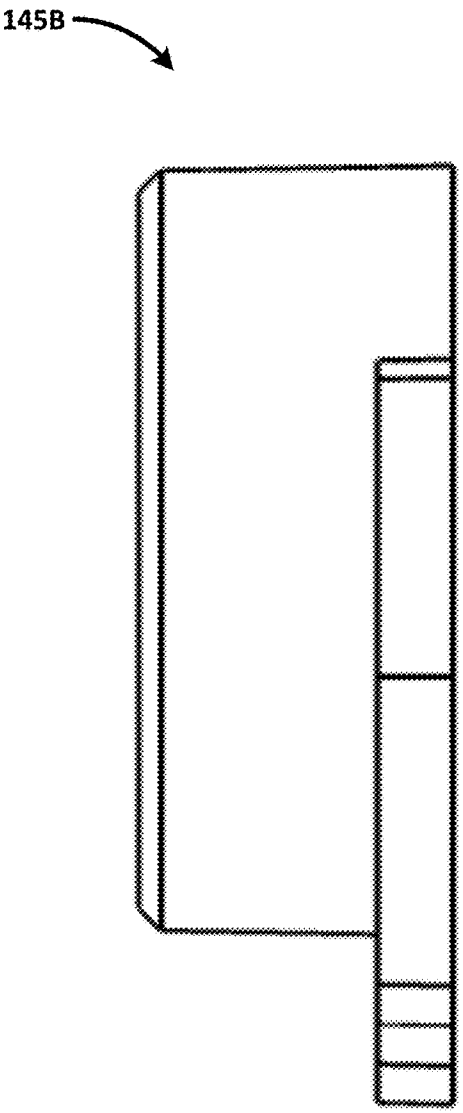
Figure 15F:
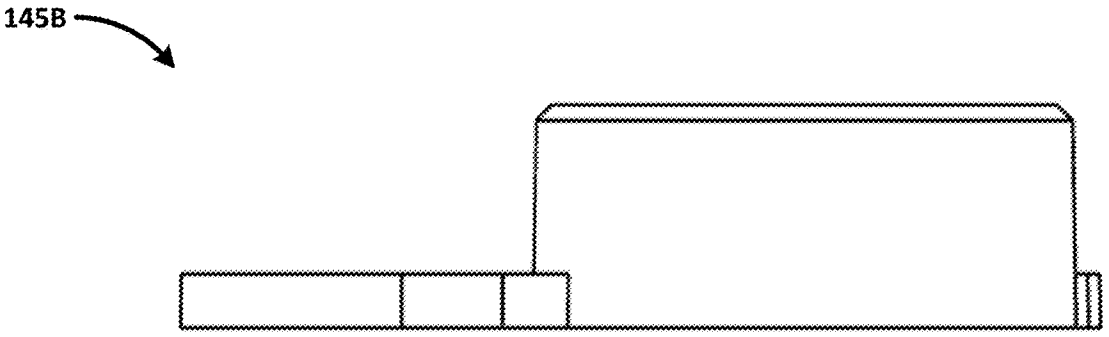
Figure 15G:
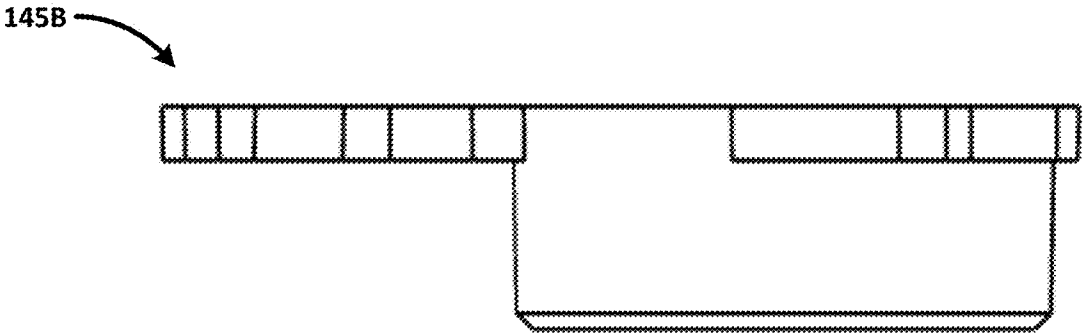

FIG. 15A, FIG. 15B, FIG. 15C, FIG. 15D, FIG. 15E, FIG. 15F, and FIG. 15G depict views of an exemplary second moon gear 145B of the exemplary access control unit 110. FIG. 15A depicts a perspective view of the exemplary second moon gear 145B. FIG. 15B depicts a left elevation view of the second moon gear 145B. FIG. 15C depicts a right elevation view of the second moon gear 145B. FIG. 15D depicts a top plan view of the second moon gear 145B. FIG. 15E depicts a front elevation view of the second moon gear 145B. FIG. 15F depicts a bottom plan view of the second moon gear 145B. FIG. 15G depicts a rear elevation view of the second moon gear 145B.

Figure 16A:
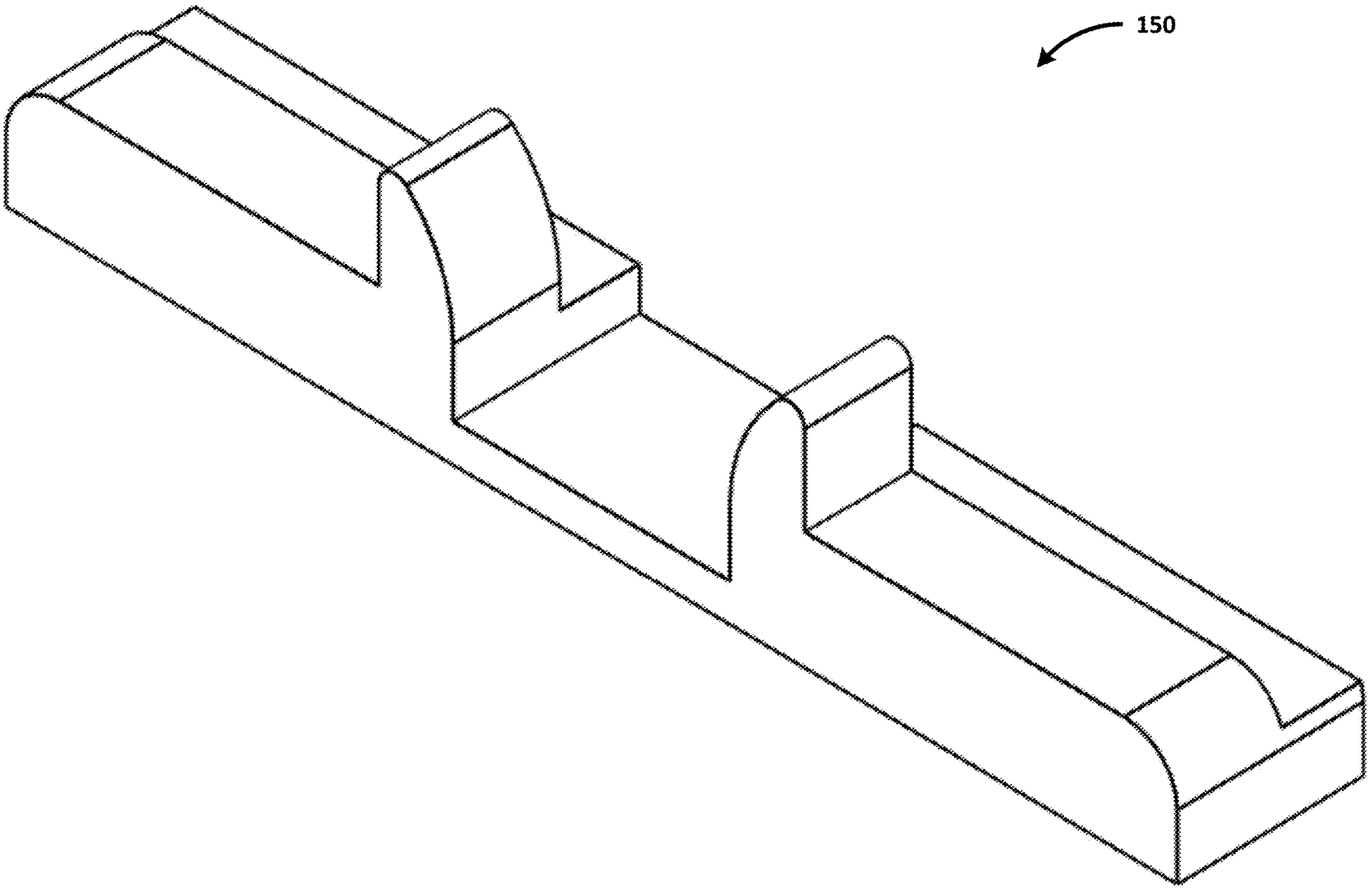
FIG. 16A, FIG. 16B, FIG. 16C, FIG. 16D, FIG. 16E, FIG. 16F, and FIG. 16G depict views of an exemplary linear slide 150 of the exemplary access control unit 110.
Figure 16C:
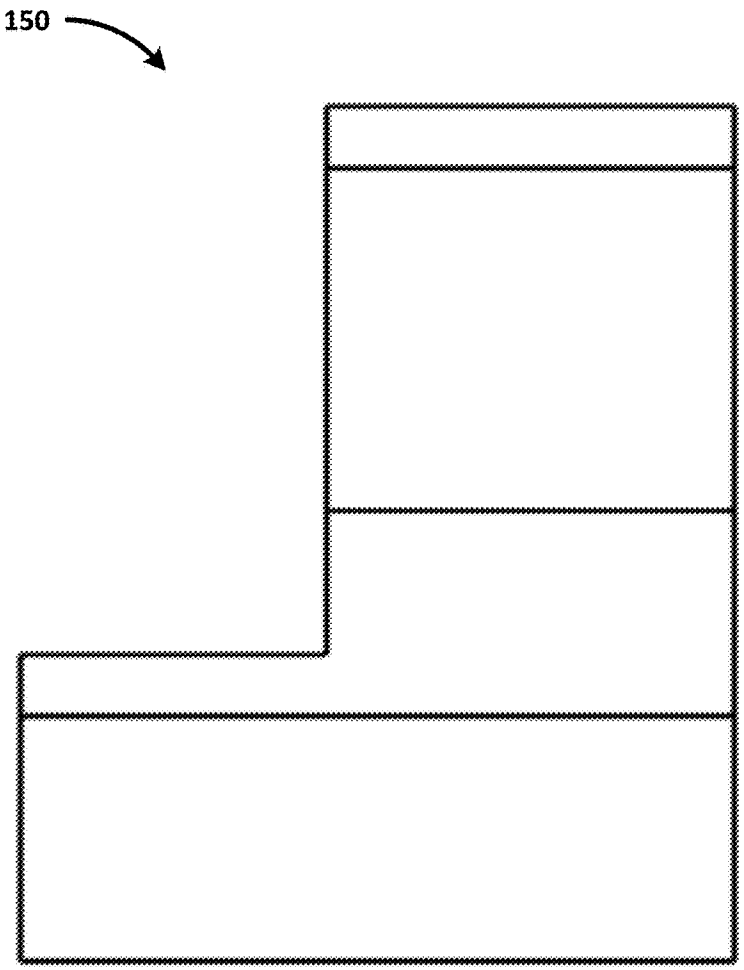
Figure 16B:
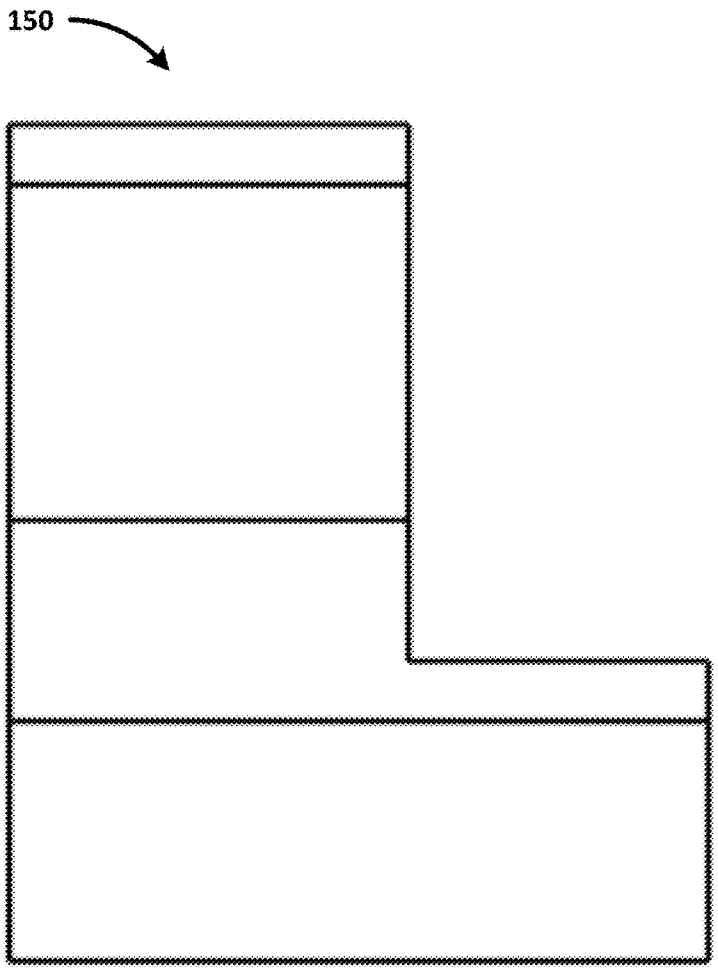
Figure 16D:
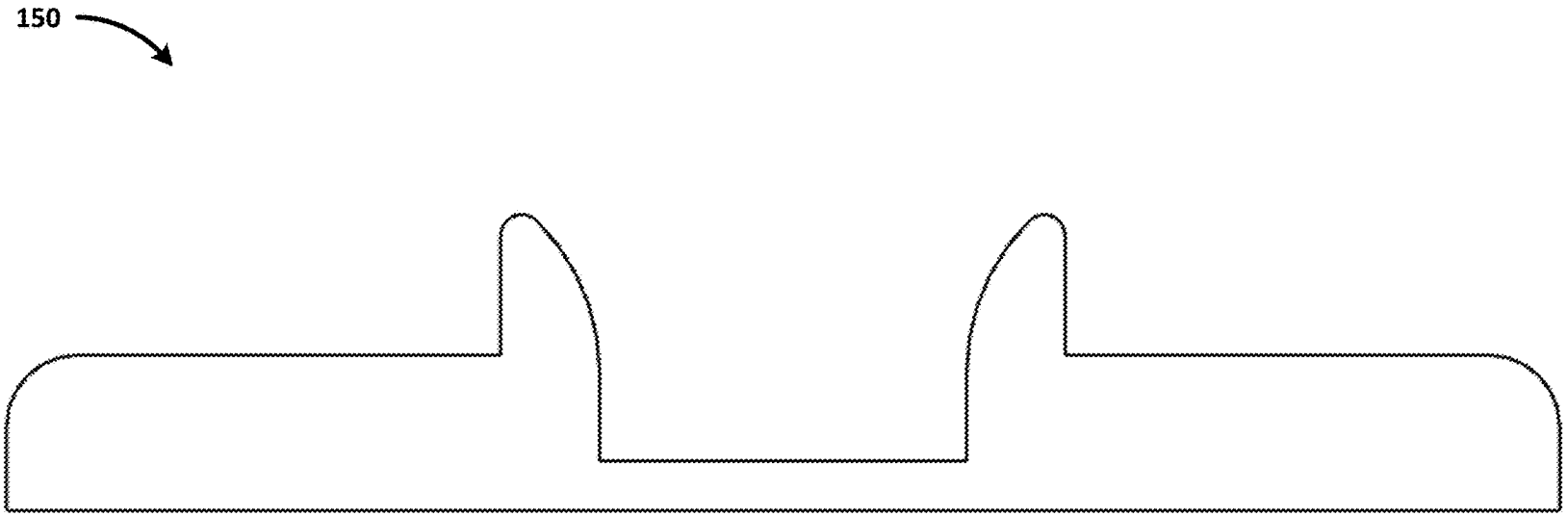
Figure 16E:
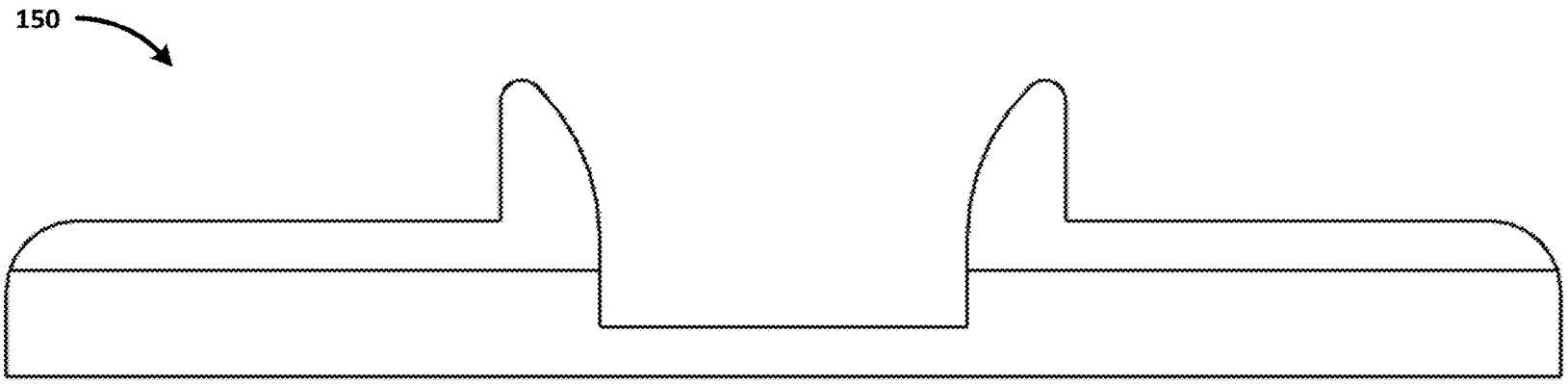
Figure 16F:
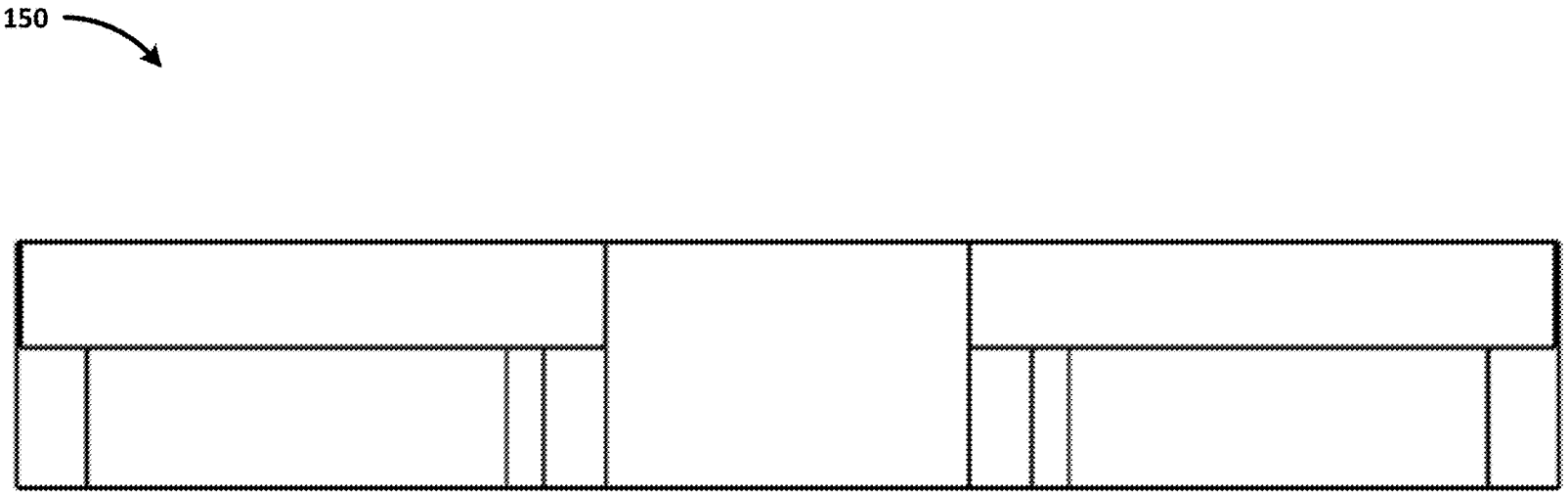
Figure 16G:
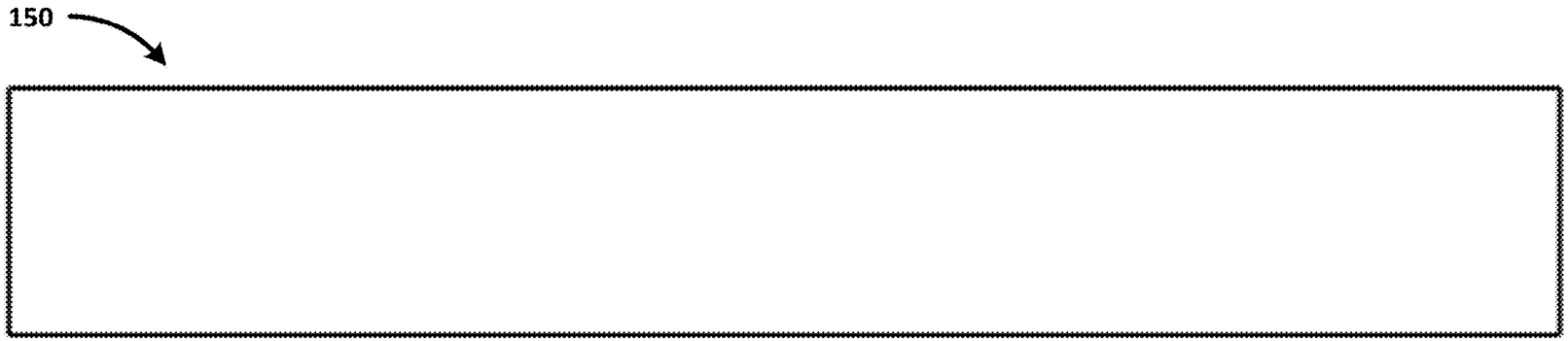

FIG. 16A, FIG. 16B, FIG. 16C, FIG. 16D, FIG. 16E, FIG. 16F, and FIG. 16G depict views of an exemplary linear slide 150 of the exemplary access control unit 110. FIG. 16A depicts a perspective view of the exemplary linear slide 150. FIG. 16B depicts a left elevation view of the linear slide 150. FIG. 16C depicts a right elevation view of the linear slide 150. FIG. 16D depicts a top plan view of the linear slide 150. FIG. 16E depicts a front elevation view of the linear slide 150. FIG. 16F depicts a bottom plan view of the linear slide 150. FIG. 16G depicts a rear elevation view of the linear slide 150.

Although various embodiments have been described with reference to the figures, other embodiments are possible. For example, in various embodiments engagement features (e.g., 320) may be configured such that a peg (e.g., 120A or 120B) may fit in only one of a pair of access ports (e.g., 115A or 115B) and/or moon gears (e.g., 145A or 145B). By way of example and not limitation, an access peg (e.g., 120A) may not fit in an access port configured for an asset peg (e.g., 115B), an asset peg (e.g., 120B) may not fit in an access port configured for an access peg (e.g., 115A), or some combination thereof accordingly, integrity of the tracking system may be maintained by preventing an asset key (e.g., corresponding to a 'low value' asset) from being used to gain access to another asset key (e.g., corresponding to a 'high value' asset), an access key (e.g., another user's access key) from being used to release another access key (e.g., an access key of a user trying to circumvent a tracking system), or some combination thereof.

For example, at least one engagement feature 320A of the first key 120A may have different width(s) than at least one corresponding engagement feature 320B of the second key 120B, such as is depicted at least with reference to FIG. 11G and FIG. 12G, respectively. The corresponding access ports (e.g., 115A and 115B, respectively) and/or cavities (e.g., 230A and 230B, respectively) may be sized such that, by way of example and not limitation, the second key 120B cannot be inserted into a port and/or cavity configured to receive the first key 120A. In various embodiments, the second key 120B may be an asset key and the first key 120A may be an access key (or vice versa). Accordingly, integrity of an object tracking system may be advantageously maintained.

In various embodiments the engagement features may be resistant to modification of one key into another key. For example, a first key 120B may not be converted into a first key 120A by simply snipping off a piece of plastic, and or quickly rubbing down a pattern on a rough surface. Accordingly, the integrity of an object tracking system may be advantageously resistant to circumvention by modification of keys.

In various embodiments engagement features may, by way of example and not limitation, be protrusions, cavities, or some combination thereof. In various embodiments the engagement features between a first key (e.g., peg) and a second key (e.g., peg) may, by way of example and not limitation, be different orientations (e.g., angle between two engagement features on a peg), dimensions (e.g., width, length, height), feature type (e.g., cavity, protrusion), position (e.g., axial, radial), pattern, geometry, or some combination thereof.

In various embodiments the carrier body and/or housing may, for example, be patterned to provide engagement features for multiple sets of interlocking apparatus. In various embodiments the pockets 405, the sliding support features 410, other features providing corollary functions, or some combination thereof may, by way of example and not limitation, be provided in the carrier 310, in the housing 305, in other appropriate housing component(s) (e.g., a unitary housing), or some combination thereof.

In various embodiments, the pockets 405 and the sliding support features 410 are unitarily formed (e.g., integrally molded) with the carrier 310. In various embodiments, features may be integrally formed (e.g., of the same and/or different material), separate components, or some combination thereof.

In various embodiments functional reflective symmetry may relate, for example, to some combination of two moon gears' main body, actuating cam, locking cam, and/or central shaft and/or aperture. The moon gears are in functional reflective symmetry at least because the actuating cam and the locking cam may be substantial mirror images in function. In various embodiments the locking cam and the actuating cam may be geometrical mirror images. In some embodiments an aperture(s) and/or key engagement features, by way of example and not limitation, may not be symmetrical between the two moon gears (e.g., feature(s) to permit a master key to be inserted in one moon gear but not in the other), while retaining functional reflective symmetry between the moon gears regarding rotation, actuation, and locking.

In various embodiments the first plane may be substantially a first plane. For example, various features may actually be in various planes substantially parallel to the first plane such that the mechanism still operate substantially in a planar manner.

Although an exemplary system has been described with reference to the figures other implementations may be deployed in other industrial, scientific, medical, commercial, and/or residential applications. For example, an access control unit 110 may be configured to track and/or control access to keys, barcode scanners, other assets, or some combination thereof. Although access control units 110 with 3 (e.g., FIG. 1) and 5 (e.g., FIG. 8) pairs of interlocking mechanisms 140 are depicted, other embodiments are possible. For example, access control units 110 may be provided with one pair, two pairs, and/or five pairs of interlocking mechanisms 140 and associated components (e.g., access ports 115). Access control units 110 may be arranged, by way of example and not limitation, horizontally and/or vertically to create a desired number of pairs of interlocking mechanisms 140.

In various embodiments an access control unit 110 and/or interlocking mechanism 140 may be configured as an IoT device. For example, a sensor (e.g., optical, presence, contact, Hall effect) may be provided which detects a presence and/or orientation of a key (e.g., a peg 120). By way of example and not limitation, an access control unit may be provided with at least one sensor configured to detect the presence of a first peg 120A, a second peg 120B, or both. A control and/or communication module may be configured to read a status of each sensor and transmit, display, and/or store the result. Accordingly, a user may query a present and/or historical status of keys to determine which keys are present and/or missing. For example, if a key is missing, a user may visually inspect a corresponding access control unit 110 to identify an access element (e.g., peg 120A) used to release the missing key (e.g., 120B).

In various embodiments, some bypass circuits implementations may be controlled in response to signals from analog or digital components, which may be discrete, integrated, or a combination of each. Some embodiments may include programmed, programmable devices, or some combination thereof (e.g., PLAs, PLDs, ASICs, microcontroller, microprocessor), and may include one or more data stores (e.g., cell, register, block, page) that provide single or multi-level digital data storage capability, and which may be volatile, non-volatile, or some combination thereof. Some control functions may be implemented in hardware, software, firmware, or a combination of any of them.

Computer program products may contain a set of instructions that, when executed by a processor device, cause the processor to perform prescribed functions. These functions may be performed in conjunction with controlled devices in operable communication with the processor. Computer program products, which may include software, may be stored in a data store tangibly embedded on a storage medium, such as an electronic, magnetic, or rotating storage device, and may be fixed or removable (e.g., hard disk, floppy disk, thumb drive, CD, DVD).

Although an example of a system, which may be portable, has been described with reference to the above figures, other implementations may be deployed in other processing applications, such as desktop and networked environments.

Temporary auxiliary energy inputs may be received, for example, from chargeable or single use batteries, which may enable use in portable or remote applications. Some embodiments may operate with other DC voltage sources, such as 1.5V, 9V, 12V, or other appropriate (nominal) voltage batteries, for example. Alternating current (AC) inputs, which may be provided, for example from a 50/60 Hz power port, or from a portable electric generator, may be received via a rectifier and appropriate scaling. Provision for AC (e.g., sine wave, square wave, triangular wave) inputs may include a line frequency transformer to provide voltage step-up, voltage step-down, and/or isolation.

Although particular features of an architecture have been described, other features may be incorporated to improve performance. For example, caching (e.g., L1, L2, . . . ) techniques may be used. Random access memory may be included, for example, to provide scratch pad memory and or to load executable code or parameter information stored for use during runtime operations. Other hardware and software may be provided to perform operations, such as network or other communications using one or more protocols, wireless (e.g., infrared) communications, stored operational energy and power supplies (e.g., batteries), switching and/or linear power supply circuits, software maintenance (e.g., self-test, upgrades), and the like. One or more communication interfaces may be provided in support of data storage and related operations.

Some systems may be implemented as a computer system that can be used with various implementations. For example, various implementations may include digital circuitry, analog circuitry, computer hardware, firmware, software, or combinations thereof. Apparatus can be implemented in a computer program product tangibly embodied in an information carrier, e.g., in a machine-readable storage device, for execution by a programmable processor; and methods can be performed by a programmable processor executing a program of instructions to perform functions of various embodiments by operating on input data and generating an output. Various embodiments can be implemented advantageously in one or more computer programs that are executable on a programmable system including at least one programmable processor coupled to receive data and instructions from, and to transmit data and instructions to, a data storage system, at least one input device, and/or at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, which may include a single processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including, by way of example, semiconductor memory devices, such as EPROM, EEPROM, and flash memory devices; magnetic disks, such as internal hard disks and removable disks; magneto-optical disks; and CD-ROM and DVD-ROM disks. The processor and the memory can be supplemented by, or incorporated in, ASICs (application-specific integrated circuits).

In some implementations, each system may be programmed with the same or similar information and/or initialized with substantially identical information stored in volatile and/or non-volatile memory. For example, one data interface may be configured to perform auto configuration, auto download, and/or auto update functions when coupled to an appropriate host device, such as a desktop computer or a server.

In some implementations, one or more user-interface features may be custom configured to perform specific functions. Various embodiments may be implemented in a computer system that includes a graphical user interface and/or an Internet browser. To provide for interaction with a user, some implementations may be implemented on a computer having a display device, such as a CRT (cathode ray tube) or LCD (liquid crystal display) monitor for displaying information to the user, a keyboard, and a pointing device, such as a mouse or a trackball by which the user can provide input to the computer.

In various implementations, the system may communicate using suitable communication methods, equipment, and techniques. For example, the system may communicate with compatible devices (e.g., devices capable of transferring data to and/or from the system) using point-to-point communication in which a message is transported directly from the source to the receiver over a dedicated physical link (e.g., fiber optic link, point-to-point wiring, daisy-chain). The components of the system may exchange information by any form or medium of analog or digital data communication, including packet-based messages on a communication network. Examples of communication networks include, e.g., a LAN (local area network), a WAN (wide area network), MAN (metropolitan area network), wireless and/or optical networks, the computers and networks forming the Internet, or some combination thereof. Other implementations may transport messages by broadcasting to all or substantially all devices that are coupled together by a communication network, for example, by using omni-directional radio frequency (RF) signals. Still other implementations may transport messages characterized by high directivity, such as RF signals transmitted using directional (i.e., narrow beam) antennas or infrared signals that may optionally be used with focusing optics. Still other implementations are possible using appropriate interfaces and protocols such as, by way of example and not intended to be limiting, USB 2.0, Firewire, ATA/IDE, RS-232, RS-422, RS-485, 802.11 a/b/g, Wi-Fi, Ethernet, IrDA, FDDI (fiber distributed data interface), token-ring networks, multiplexing techniques based on frequency, time, or code division, or some combination thereof. Some implementations may optionally incorporate features such as error checking and correction (ECC) for data integrity, or security measures, such as encryption (e.g., WEP) and password protection.

In various embodiments, the computer system may include Internet of Things (IoT) devices. IoT devices may include objects embedded with electronics, software, sensors, actuators, and network connectivity which enable these objects to collect and exchange data. IoT devices may be in-use with wired or wireless devices by sending data through an interface to another device. IoT devices may collect useful data and then autonomously flow the data between other devices.

Various examples of modules may be implemented using circuitry, including various electronic hardware. By way of example and not limitation, the hardware may include transistors, resistors, capacitors, switches, integrated circuits, other modules, or some combination thereof. In various examples, the modules may include analog logic, digital logic, discrete components, traces and/or memory circuits fabricated on a silicon substrate including various integrated circuits (e.g., FPGAs, ASICs), or some combination thereof. In some embodiments, the module(s) may involve execution of preprogrammed instructions, software executed by a processor, or some combination thereof. For example, various modules may involve both hardware and software.

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. An access control system comprising at least one interlocking mechanism, each at least one interlocking mechanism comprising:

two moon gears in a first plane, the two moon gears in substantial functional reflective symmetry with each other and configured to rotate about respective axes of rotation orthogonal to the first plane; and, a linear slide in the first plane, the linear slide configured to respond to rotation of the moon gears by translation in the first plane along a third axis orthogonal to an axis of reflective symmetry of the moon gears such that:

when one of the moon gears rotates in a first rotational direction, an actuating cam of the moon gear displaces the linear slide along the third axis towards the axis of rotation of the other moon gear and thereby engages an actuating cam of the other moon gear to thereby rotate the other moon gear in the first rotational direction until a locking cam of the other moon gear releasably secures a first follower of the linear slide such that a second follower of the linear slide is displaced past a cam surface of the locking cam of the moon gear, thereby placing the moon gear into a first mode and the other moon gear into a second mode, and, when the other moon gear rotates in an opposite rotational direction, the moon gear is placed into the second mode and the other moon gear is placed into the first mode; and, a housing comprising at least one pair of access ports corresponding to the two moon gears, wherein each access port is configured to register a key with the axis of rotation of the corresponding moon gear when the key is inserted into the access port.

2. The access control system of claim 1, wherein the locking cam is hook shaped and comprises:

a proximal portion extending radially from the moon gear relative to the axis of rotation of the moon gear; and, a distal portion extending orthogonal to the proximal portion from a distal end of the proximal portion.

3. The access control system of claim 1, wherein the actuating cam of each moon gear protrudes radially from the moon gear relative to the axis of rotation of the moon gear.

4. The access control system of claim 1, further comprising a carrier, the carrier comprising:

at least one pair of cavities configured to receive the two moon gears, each moon gear rotatably supported within a respective one of the pair of cavities; and, at least one bearing surface configured to support the linear slide.

5. The access control system of claim 1, further comprising a carrier configured to receive the at least one interlocking mechanism wherein:

the moon gears of the at least one interlocking mechanism are distributed along a longitudinal axis of the carrier, and, a distance from a first moon gear of the at least one interlocking mechanism to a first end of the carrier is greater than a distance from a last moon gear of the at least one interlocking mechanism to a second end of the carrier.

6. The access control system of claim 1, wherein each access port further comprises at least one orientation limiting element configured to engage a corresponding element on a key, when the key is inserted into the access port and engages a cavity of the corresponding moon gear, such that rotation of the key is limited to a predetermined range of rotation.

7. The access control system of claim 1, wherein each moon gear comprises a cavity configured to receive an access peg.

8. The access control system of claim 7, wherein each cavity comprises a plurality of lobes extending radially from the respective axis of rotation.

9. The access control system of claim 8, wherein a first lobe of the plurality of lobes in the cavity in one of the moon gears has a different width than a corresponding lobe in the cavity in the other moon gear.

10. An access control system comprising:

two moon gears in a first plane, the two moon gears in substantial functional reflective symmetry with each other and configured to rotate about respective axes of rotation orthogonal to the first plane; and, a linear slide in the first plane, the linear slide configured to respond to rotation of the moon gears by translation in the first plane along a third axis orthogonal to an axis of reflective symmetry of the moon gears such that:

when one of the moon gears rotates in a first rotational direction, an actuating cam of the moon gear displaces the linear slide along the third axis towards the axis of rotation of the other moon gear and thereby engages an actuating cam of the other moon gear to thereby rotate the other moon gear in the first rotational direction until a locking cam of the other moon gear releasably secures a first follower of the linear slide such that a second follower of the linear slide is displaced past a cam surface of the locking cam of the moon gear such that the locking cam of the moon gear is prevented from engaging the second follower until the actuator cam of the other moon gear displaces the linear slide along the third axis towards the axis of rotation of the moon gear, thereby placing the moon gear into a first mode and the other moon gear into a second mode, and, when the other moon gear rotates in an opposite rotational direction, the moon gear is placed into the second mode and the other moon gear is placed into the first mode.

11. The access control system of claim 10, wherein the locking cam is hook shaped and comprises:

a proximal portion extending radially from the moon gear relative to the axis of rotation of the moon gear; and, a distal portion extending orthogonal to the proximal portion from a distal end of the proximal portion.

12. The access control system of claim 10, wherein the actuating cam of each moon gear protrudes radially from the moon gear relative to the axis of rotation of the moon gear.

13. The access control system of claim 10, further comprising a carrier, the carrier comprising:

at least one pair of cavities configured to receive the two moon gears, each moon gear rotatably supported within a respective one of the pair of cavities; and, at least one bearing surface configured to support the linear slide.

14. The access control system of claim 10, further comprising a carrier configured to receive the at least one interlocking mechanism wherein:

the moon gears of the at least one interlocking mechanism are distributed along a longitudinal axis of the carrier, and, a distance from a first moon gear of the at least one interlocking mechanism to a first end of the carrier is greater than a distance from a last moon gear of the at least one interlocking mechanism to a second end of the carrier.

15. The access control system of claim 10, further comprising a housing, the housing comprising:

at least one pair of access ports corresponding to the two moon gears, wherein each access port is configured to register a key with the axis of rotation of the corresponding moon gear when the key is inserted into the access port.

16. The access control system of claim 15, wherein each access port further comprises at least one orientation limiting element configured to engage a corresponding element on a key, when the key is inserted into the access port and engages a cavity of the corresponding moon gear, such that rotation of the key is limited to a predetermined range of rotation.

17. The access control system of claim 10, wherein each moon gear comprises a cavity configured to receive an access peg.

18. The access control system of claim 17, wherein each cavity comprises a plurality of lobes extending radially from the respective axis of rotation.

19. The access control system of claim 18, wherein a first lobe of the plurality of lobes in the cavity in one of the moon gears has a different width than a corresponding lobe in the cavity in the other moon gear.

20. The access control system of claim 10, further comprising a shaft corresponding to each moon gear and extending along the corresponding axis of rotation.

* * * * *